US010948848B1

(12) United States Patent
Ota et al.

(10) Patent No.: US 10,948,848 B1
(45) Date of Patent: Mar. 16, 2021

(54) IMAGE FORMING APPARATUS AND TONER CARTRIDGE

(71) Applicant: FUJI XEROX CO., LTD., Tokyo (JP)

(72) Inventors: Naoki Ota, Kanagawa (JP); Yusuke Fukuda, Kanagawa (JP); Masataka Kuribayashi, Kanagawa (JP); Katsuyuki Kitajima, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 16/783,454

(22) Filed: Feb. 6, 2020

(30) Foreign Application Priority Data

Sep. 17, 2019 (JP) ..... JP2019-168273

(51) Int. Cl.
*G03G 15/08* (2006.01)

(52) U.S. Cl.
CPC ..... *G03G 15/0865* (2013.01); *G03G 15/0867* (2013.01)

(58) Field of Classification Search
CPC ..... G03G 15/087; G03G 15/0865; G03G 15/0867; G03G 15/0868; G03G 15/0872; G03G 15/0877; G03G 2215/06; G03G 2215/066; G03G 2215/0602; G03G 2215/0604; G03G 2215/0607; G03G 2215/0663; G03G 2215/0665; G03G 2215/0668; G03G 2215/0678; G03G 2215/0685
See application file for complete search history.

(56) References Cited

U.S. PATENT DOCUMENTS 7,398,038 B2 7/2008 Tsuda et al.
9,442,404 B1 * 9/2016 Saito ..... G03G 9/0827
2007/0280741 A1 * 12/2007 Tanaka ..... G03G 15/0875 399/258

(Continued)

FOREIGN PATENT DOCUMENTS

JP 2001-194824 A 7/2001
JP 2004-139031 A 5/2004

(Continued)

*Primary Examiner* — Thomas S Giampaolo, II
(74) *Attorney, Agent, or Firm* — Sughrue Mion, PLLC

(57) ABSTRACT

An image forming apparatus includes an image holding member, a charging unit, an electrostatic image forming unit, a developing unit that includes an electrostatic image developer and develops the electrostatic image with the electrostatic image developer, a transfer unit, a fixing unit, a replenishment toner container that includes a replenishment toner that is to be supplied into the developing unit and discharges the replenishment toner by rotation of the replenishment toner container, a replenishment toner container mounting unit that holds the replenishment toner container and rotates the replenishment toner container, and a toner supply pass that connects the replenishment toner container mounting unit to the developing unit. The replenishment toner includes toner particles and silica particles having a number average particle size of 110 nm to 130 nm, a large-diameter-side number particle size distribution index (upper GSDp) of less than 1.080, and an average circularity of 0.94 to 0.98, wherein 80 number % or more of the silica particles have a circularity of 0.92 or more.

14 Claims, 3 Drawing Sheets

(56) References Cited

U.S. PATENT DOCUMENTS

| | | | | |
|---|---|---|---|---|
| 2012/0222776 | A1* | 9/2012 | Sakamoto | G03G 15/0879 141/369 |
| 2013/0059244 | A1 | 3/2013 | Iwanaga et al. | |
| 2016/0091819 | A1* | 3/2016 | Shinozaki | G03G 15/0865 399/262 |
| 2017/0073236 | A1 | 3/2017 | Okuno et al. | |
| 2017/0315459 | A1* | 11/2017 | Iguchi | G03G 9/0827 |

FOREIGN PATENT DOCUMENTS

| | | | |
|---|---|---|---|
| JP | 2008-174430 | A | 7/2008 |
| JP | 2013-053027 | A | 3/2013 |
| JP | 2017-057094 | A | 3/2017 |

* cited by examiner

IMAGE FORMING APPARATUS AND TONER CARTRIDGE

CROSS-REFERENCE TO RELATED APPLICATIONS

This application is based on and claims priority under 35 USC 119 from Japanese Patent Application No. 2019-168273 filed Sep. 17, 2019.

BACKGROUND

(i) Technical Field

The present disclosure relates to an image forming apparatus and a toner cartridge.

(ii) Related Art

Japanese Laid Open Patent Application Publication No. 2004-139031 discloses a toner bottle that includes a bottle main body in which a groove is formed in a helical pattern and discharges a toner by rotation of the toner bottle.

Japanese Laid Open Patent Application Publication No. 2017-057094 discloses silica particles having a compression aggregation degree of 60% or more and 95% or less, a particle compression ratio of 0.20 or more and 0.40 or less, an average equivalent circle diameter of 40 nm or more and 200 nm or less, and a particle dispersion degree of 90% or more and 100% or less.

Japanese Laid Open Patent Application Publication No. 2013-053027 discloses silica particles having a volume average particle size of 80 nm or more and 300 nm or less, an average circularity of 0.92 or more and 0.935 or less, and a circularity geometric standard deviation of 1.02 or more and 1.15 or less and a toner that includes the above silica particles.

Japanese Laid Open Patent Application Publication No. 2008-174430 discloses hydrophobic spherical silica particles having a size of 0.01 to 5 μm and a circularity of 0.8 to 1.

Japanese Laid Open Patent Application Publication No. 2001-194824 discloses hydrophobic spherical silica particles having an average size of 0.01 to 5 μm.

SUMMARY

Aspects of non-limiting embodiments of the present disclosure relate to an image forming apparatus capable of reducing the occurrence of fog in a low temperature, low humidity environment and limiting a reduction in image density which occurs in a high temperature, high humidity environment compared with the case where a replenishment toner container that discharges a replenishment toner by rotation of the replenishment toner container includes a replenishment toner including silica particles having a number average particle size of 110 nm or more and 130 nm or less and a large-diameter-side number particle size distribution index (upper GSDp) of 1.080 or more.

Aspects of certain non-limiting embodiments of the present disclosure address the above advantages and/or other advantages not described above. However, aspects of the non-limiting embodiments are not required to address the advantages described above, and aspects of the non-limiting embodiments of the present disclosure may not address advantages described above.

According to an aspect of the present disclosure, there is provided an image forming apparatus including an image holding member, a charging unit that charges a surface of the image holding member, an electrostatic image forming unit that forms an electrostatic image on the charged surface of the image holding member, a developing unit that includes an electrostatic image developer and develops the electrostatic image formed on the surface of the image holding member with the electrostatic image developer to form a toner image, a transfer unit that transfers the toner image onto a surface of a recording medium, a fixing unit that fixes the toner image transferred on the surface of the recording medium, a replenishment toner container that includes a replenishment toner that is to be supplied into the developing unit and discharges the replenishment toner by rotation of the replenishment toner container, a replenishment toner container mounting unit that holds the replenishment toner container and rotates the replenishment toner container, and a toner supply pass that connects the replenishment toner container mounting unit to the developing unit and supplies the replenishment toner into the developing unit. The replenishment toner includes toner particles, and silica particles having a number average particle size of 110 to 130 nm, a large-diameter-side number particle size distribution index (upper GSDp) of less than 1.080, and an average circularity of 0.94 to 0.98, wherein 80 number % or more of the silica particles have a circularity of 0.92 or more.

BRIEF DESCRIPTION OF THE DRAWINGS

An exemplary embodiment of the present disclosure will be described in detail based on the following figures, wherein.

DETAILED DESCRIPTION

Figure 1:
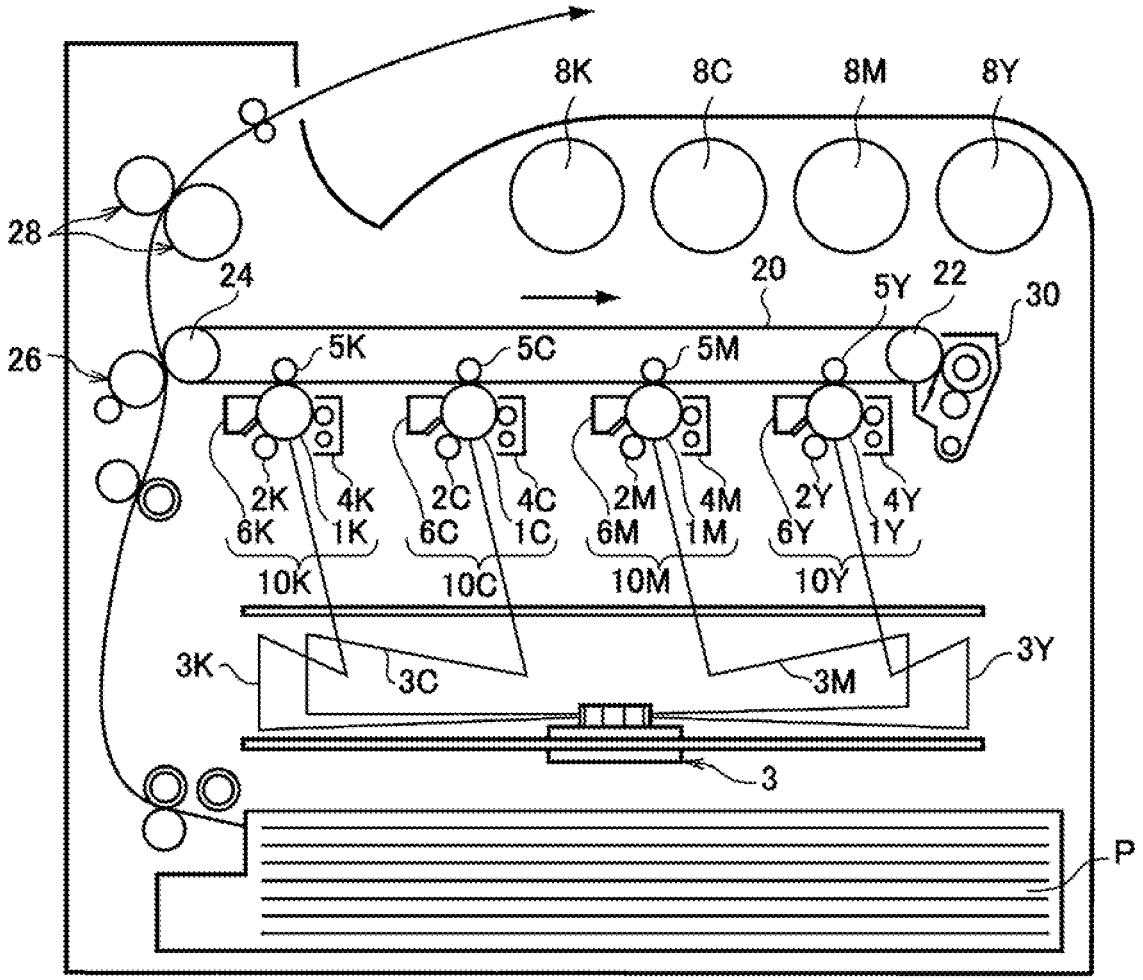
FIG. 1 is a schematic diagram illustrating an example of an image forming apparatus according to an exemplary embodiment.

An exemplary embodiment of the present disclosure is described below. The following description and Examples below are intended to be illustrative of the exemplary embodiment and not restrictive of the scope of the exemplary embodiment.

In the present disclosure, a numerical range expressed using "to" means the range specified by the minimum and maximum described before and after "to", respectively.

In the present disclosure, when numerical ranges are described in a stepwise manner, the upper or lower limit of a numerical range may be replaced with the upper or lower limit of another numerical range, respectively. In the present disclosure, the upper and lower limits of a numerical range may be replaced with the upper and lower limits described in Examples below.

The term "step" used herein refers not only to an individual step but also to a step that is not distinguishable from other steps but achieves the intended purpose of the step.

In the present disclosure, when an exemplary embodiment is described with reference to a drawing, the structure of the exemplary embodiment is not limited to the structure illustrated in the drawing. The sizes of the members illustrated in the attached drawings are conceptual and do not limit the relative relationship among the sizes of the members.

Each of the components described in the present disclosure may include plural types of substances that correspond to the component. In the present disclosure, in the case where a composition includes plural substances that correspond to a component of the composition, the content of the component in the composition is the total content of the plural substances in the composition unless otherwise specified.

In the present disclosure, the number of types of particles that correspond to a component may be two or more. In the case where a composition includes plural types of particles that correspond to a component of the composition, the particle size of the component is the particle size of a mixture of the plural types of particles included in the composition unless otherwise specified.

The term "(meth)acryl" used herein refers to either "acryl" or "methacryl".

Image Forming Apparatus

An image forming apparatus according to the exemplary embodiment includes:

an image holding member;

a charging unit that charges a surface of the image holding member;

an electrostatic image forming unit that forms an electrostatic image on the charged surface of the image holding member;

a developing unit that includes an electrostatic image developer and develops the electrostatic image formed on the surface of the image holding member with the electrostatic image developer to form a toner image;

a transfer unit that transfers the toner image formed on the surface of the image holding member onto a surface of a recording medium;

a fixing unit that fixes the toner image transferred on the surface of the recording medium;

a replenishment toner container that includes a replenishment toner that is to be supplied into the developing unit and discharges the replenishment toner by rotation of the replenishment toner container;

a replenishment toner container mounting unit that holds the replenishment toner container and rotates the replenishment toner container; and a toner supply pass that connects the replenishment toner container mounting unit to the developing unit and supplies the replenishment toner into the developing unit.

In the image forming apparatus according to the exemplary embodiment, the replenishment toner includes toner particles and silica particles having a number average particle size of 110 nm or more and 130 nm or less, a large-diameter-side number particle size distribution index (upper GSDp) of less than 1.080, and an average circularity of 0.94 or more and 0.98 or less, wherein 80 number % or more of the silica particles have a circularity of 0.92 or more.

The image forming apparatus according to the exemplary embodiment may reduce the occurrence of fog in a low temperature, low humidity environment (e.g., at 10° C. and a relative humidity of 10%) and limit a reduction in image density which may occur in a high temperature, high humidity environment (e.g., at 30° C. and a relative humidity of 85%). The mechanisms for this are presumably as follows.

A replenishment toner container that discharges a toner by rotation of the replenishment toner container (hereinafter, such a toner container is referred to as "rotary toner bottle") is known. A rotary toner bottle is superior to a replenishment toner container that includes a toner stirring unit, such as an auger screw, in terms of the efficiency of recycling containers and a reduction in the mechanical load placed on a toner. Since a rotary toner bottle does not include a toner stirring unit, the flowability of a toner greatly affects the efficiency of discharging the toner. Thus, the improvement of environmental stability of the flowability of a toner is anticipated in order to increase the consistency in the amount of the toner supplied when a rotary toner bottle is used and to reduce image defects. Accordingly, in the exemplary embodiment, the replenishment toner has the following structure.

The replenishment toner includes, as an external additive, silica particles having a number average particle size of 110 nm or more and 130 nm or less (hereinafter, such silica particles are referred to as "large-diameter silica particles") in expectation of the effect of maintaining adequate distances between toner particles (i.e., spacer effect). The large-diameter silica particles may include silica particles having further large diameters (hereinafter, such silica particles are referred to as "coarse silica particles"). The coarse silica particles may further enhance the flowability of the toner. Accordingly, a toner that includes the coarse silica particles may be readily discharged from the replenishment toner container and, consequently, an excessively large amount of toner may be supplied into the developing unit. If the amount of the toner present inside the developing unit is excessively large, the amount of charge generated by the friction between the toner and a carrier inside the developing unit may become insufficient and, as a result, fog may occur. Note that, the term "fog" used herein refers to the phenomenon in which an unwanted dot-like image appears on an image forming surface of a recording medium. This phenomenon is significant in a low temperature, low humidity environment, in which the flowability of a toner is enhanced.

Accordingly, in the exemplary embodiment, the large-diameter-side number particle size distribution index (upper GSDp) of the large-diameter silica particles included in the replenishment toner is limited to be less than 1.080, that is, the content of the coarse silica particles is limited in order to reduce the above phenomenon and the occurrence of fog in a low temperature, low humidity environment.

If the average circularity of the large-diameter silica particles exceeds 0.98, the flowability of the toner is high and an excessively large amount of toner may be supplied into the developing unit. Accordingly, the average circularity of the large-diameter silica particles is limited to be 0.98 or less in order to reduce the occurrence of fog in a low temperature, low humidity environment.

While the large-diameter silica particles are used as an external additive for a toner in expectation of the spacer effect, if the large-diameter silica particles have a low circularity, the number of points at which a large-diameter silica particle comes into contact with toner particles is increased and, consequently, aggregation of the toner particles may occur. Thus, a toner that includes large-diameter silica particles having a low circularity is likely to become aggregated inside the replenishment toner container and, as a result, the amount of toner supplied into the developing unit may become insufficient. This results in a reduction in image density. The above phenomenon is significant in a high temperature, high humidity environment, in which the flowability of a toner becomes degraded.

Accordingly, in the exemplary embodiment, the average circularity of the large-diameter silica particles included in the replenishment toner is limited to be 0.94 or more and the proportion of large-diameter silica particles having a circularity of 0.92 or more is limited to be 80 number % or more in order to reduce the above phenomenon and thereby limit a reduction in image density which may occur in a high temperature, high humidity environment.

Details of the structure of the image forming apparatus according to the exemplary embodiment are described below.

The image forming apparatus according to the exemplary embodiment may be any image forming apparatus known in the related art, such as a direct-transfer image forming apparatus in which a toner image formed on the surface of an image holding member is directly transferred to a recording medium; an intermediate-transfer image forming apparatus in which a toner image formed on the surface of an image holding member is transferred onto the surface of an intermediate transfer body in the first transfer step and the toner image transferred on the surface of the intermediate transfer body is transferred onto the surface of a recording medium in the second transfer step; an image forming apparatus including a cleaning unit that cleans the surface of an image holding member subsequent to the transfer of the toner image before the image holding member is again charged; and an image forming apparatus including an erasing unit that erases static by irradiating the surface of an image holding member with erasing light subsequent to the transfer of the toner image before the image holding member is again charged.

In the case where the image forming apparatus according to the exemplary embodiment is an image forming apparatus using the intermediate transfer system, the transfer unit may be constituted by, for example, an intermediate transfer body to which a toner image is transferred, a first transfer subunit that transfers a toner image formed on the surface of the image holding member onto the surface of the intermediate transfer body in the first transfer step, and a second transfer subunit that transfers the toner image transferred on the surface of the intermediate transfer body onto the surface of a recording medium in the second transfer step.

In the image forming apparatus according to the exemplary embodiment, for example, a portion including the developing unit may have a cartridge structure (i.e., process cartridge) detachably attachable to the image forming apparatus. An example of the process cartridge is a process cartridge including an electrostatic image developer and the developing unit.

Using the image forming apparatus according to the exemplary embodiment, an image forming method that includes a charging step of charging a surface of the image holding member, an electrostatic image forming step of forming an electrostatic image on the charged surface of the image holding member, a developing step of developing the electrostatic image formed on the surface of the image holding member with the electrostatic image developer to form a toner image, a transfer step of transferring the toner image formed on the surface of the image holding member onto a surface of a recording medium, a fixing step of fixing the toner image transferred on the surface of the recording medium, and a toner supplying step of supplying the replenishment toner from the replenishment toner container into the developing unit through the toner supply pass that connects the replenishment toner container mounting unit to the developing unit is performed.

An example of the image forming apparatus according to the exemplary embodiment is described below, but the image forming apparatus is not limited thereto. Hereinafter, only components illustrated in drawings are described; others are omitted.

FIG. 1 schematically illustrates the image forming apparatus according to the exemplary embodiment.

The image forming apparatus illustrated in FIG. 1 includes first to fourth electrophotographic image forming units 10Y, 10M, 10C, and 10K that form yellow (Y), magenta (M), cyan (C), and black (K) images, respectively, on the basis of color separation image data. The image forming units (hereinafter, referred to simply as "units") 10Y, 10M, 10C, and 10K are horizontally arranged in parallel at a predetermined distance from one another. The units 10Y, 10M, 10C, and 10K may be process cartridges detachably attachable to the image forming apparatus.

An intermediate transfer belt (example of the intermediate transfer body) 20 runs above and extends over the units 10Y, 10M, 10C, and 10K. The intermediate transfer belt 20 is wound around a drive roller 22 and a support roller 24 and runs clockwise in FIG. 1, that is, in the direction from the first unit 10Y to the fourth unit 10K. Using a spring or the like (not illustrated), a force is applied to the support roller 24 in a direction away from the drive roller 22, thereby applying tension to the intermediate transfer belt 20 wound around the drive roller 22 and the support roller 24. An intermediate transfer body cleaning device 30 is disposed so as to come into contact with the image-carrier-side surface of the intermediate transfer belt 20 and to face the drive roller 22.

The image forming apparatus illustrated in FIG. 1 includes toner cartridges 8Y, 8M, 8C, and 8K (examples of the replenishment toner container) that are detachably attachable to the image forming apparatus. The developing devices 4Y, 4M, 4C, and 4K of the units 10Y, 10M, 10C, and 10K are connected to the toner cartridges 8Y, 8M, 8C, and 8K, respectively, with the replenishment toner container mounting units and the toner supply pass (all not illustrated). Yellow, magenta, cyan, and black toners are supplied from the toner cartridges 8Y, 8M, 8C, and 8K into the developing devices 4Y, 4M, 4C, and 4K, respectively, through the toner supply pass. When the amount of toner contained in a toner cartridge is small, the toner cartridge is replaced.

Since the first to fourth units 10Y, 10M, 10C, and 10K have the same structure and the same action, the following description is made with reference to, as a representative, the first unit 10Y that forms a yellow image and is located upstream in a direction in which the intermediate transfer belt runs.

The first unit 10Y includes a photosensitive member 1Y serving as an image holding member. The following components are disposed around the photosensitive member 1Y sequentially in the counterclockwise direction: a charging roller (example of the charging unit) 2Y that charges the surface of the photosensitive member 1Y at a predetermined potential; an exposure device (example of the electrostatic image forming unit) 3 that forms an electrostatic image by irradiating the charged surface of the photosensitive member 1Y with a laser beam 3Y based on a color separated image signal; a developing device (example of the developing unit) 4Y that develops the electrostatic image by supplying a charged toner to the electrostatic image; a first transfer roller (example of the first transfer subunit) 5Y that transfers the developed toner image to the intermediate transfer belt 20; and a photosensitive member cleaning device (example of the cleaning unit) 6Y that removes a toner remaining on the surface of the photosensitive member 1Y after the first transfer.

The first transfer roller 5Y is disposed so as to be in contact with the inner surface of the intermediate transfer belt 20 and to face the photosensitive member 1Y. Each of the first transfer rollers 5Y, 5M, 5C, and 5K of the respective units is connected to a bias power supply (not illustrated) that applies a first transfer bias to the first transfer rollers. Each bias power supply varies the transfer bias applied to the corresponding first transfer roller on the basis of the control by a controller (not illustrated).

The action of forming a yellow image in the first unit 10Y is described below.

Before the action starts, the surface of the photosensitive member 1Y is charged at a potential of −600 to −800 V by the charging roller 2Y.

The photosensitive member 1Y is formed by stacking a photosensitive layer on a conductive substrate (e.g., volume resistivity at 20° C.: $1\times10^{-6}$ Ωcm or less). The photosensitive layer is normally of high resistance (comparable with the resistance of ordinary resins), but, upon being irradiated with the laser beam, the specific resistance of the portion irradiated with the laser beam varies. Thus, the exposure device 3 irradiates the surface of the charged photosensitive member 1Y with the laser beam 3Y on the basis of the image data of the yellow image sent from the controller (not illustrated). As a result, an electrostatic image of yellow image pattern is formed on the surface of the photosensitive member 1Y.

The term "electrostatic image" used herein refers to an image formed on the surface of the photosensitive member 1Y by charging, the image being a "negative latent image" formed by irradiating a portion of the photosensitive layer with the laser beam 3Y to reduce the specific resistance of the irradiated portion such that the charges on the irradiated surface of the photosensitive member 1Y discharge while the charges on the portion that is not irradiated with the laser beam 3Y remain.

The electrostatic image, which is formed on the photosensitive member 1Y as described above, is sent to the predetermined developing position by the rotating photosensitive member 1Y. The electrostatic image on the photosensitive member 1Y is developed and visualized in the form of a toner image by the developing device 4Y at the developing position.

The developing device 4Y includes an electrostatic image developer including, for example, at least, a yellow toner and a carrier. The yellow toner is stirred in the developing device 4Y to be charged by friction and supported on a developer roller (example of the developer support), carrying an electric charge of the same polarity (i.e., negative) as the electric charge generated on the photosensitive member 1Y. The yellow toner is electrostatically adhered to the erased latent image portion on the surface of the photosensitive member 1Y as the surface of the photosensitive member 1Y passes through the developing device 4Y. Thus, the latent image is developed using the yellow toner. The photosensitive member 1Y on which the yellow toner image is formed keeps rotating at the predetermined rate, thereby transporting the toner image developed on the photosensitive member 1Y to the predetermined first transfer position.

Upon the yellow toner image on the photosensitive member 1Y reaching the first transfer position, first transfer bias is applied to the first transfer roller 5Y so as to generate an electrostatic force on the toner image in the direction from the photosensitive member 1Y toward the first transfer roller 5Y. Thus, the toner image on the photosensitive member 1Y is transferred to the intermediate transfer belt 20. The transfer bias applied has the opposite polarity (+) to that of the toner (−) and controlled to be, in the first unit 10Y, for example, +10 μA by a controller (not illustrated).

The toner remaining on the photosensitive member 1Y is removed by the photosensitive member cleaning device 6Y and then collected.

Each of the first transfer biases applied to first transfer rollers 5M, 5C, and 5K of the second, third, and fourth units 10M, 10C, and 10K is controlled in accordance with the first unit 10Y.

Thus, the intermediate transfer belt 20, on which the yellow toner image is transferred in the first unit 10Y, is successively transported through the second to fourth units 10M, 10C, and 10K while toner images of the respective colors are stacked on top of another.

The resulting intermediate transfer belt 20 on which toner images of four colors are multiple transferred in the first to fourth units is then transported to a second transfer section including a support roller 24 being in contact with the inner surface of the intermediate transfer belt 20 and a second transfer roller (example of the second transfer subunit) 26 disposed on the image-carrier-side of the intermediate transfer belt 20. A recording paper (example of the recording medium) P is fed by a feed mechanism into a narrow space between the second transfer roller 26 and the intermediate transfer belt 20 that are brought into contact with each other at the predetermined timing. The second transfer bias is then applied to the support roller 24. The transfer bias applied here has the same polarity (−) as that of the toner (−) and generates an electrostatic force on the toner image in the direction from the intermediate transfer belt 20 toward the recording paper P. Thus, the toner image on the intermediate transfer belt 20 is transferred to the recording paper P. The intensity of the second transfer bias applied is determined on the basis of the resistance of the second transfer section which is detected by a resistance detector (not illustrated) that detects the resistance of the second transfer section and controlled by changing voltage.

Subsequently, the recording paper P is transported into a nip part of the fixing device (example of the fixing unit) 28 at which a pair of fixing rollers are brought into contact with each other. The toner image is fixed to the recording paper P to form a fixed image.

Examples of the recording paper P to which a toner image is transferred include plain paper used in electrophotographic copiers, printers, and the like. Instead of the recording paper P, OHP films and the like may be used as a recording medium.

The surface of the recording paper P may be smooth in order to enhance the smoothness of the surface of the fixed image. Examples of such a recording paper include coated paper produced by coating the surface of plain paper with resin or the like and art paper for printing.

The recording paper P, to which the color image has been fixed, is transported toward an exit portion. Thus, the series of the steps for forming a color image are terminated.

Figure 2:
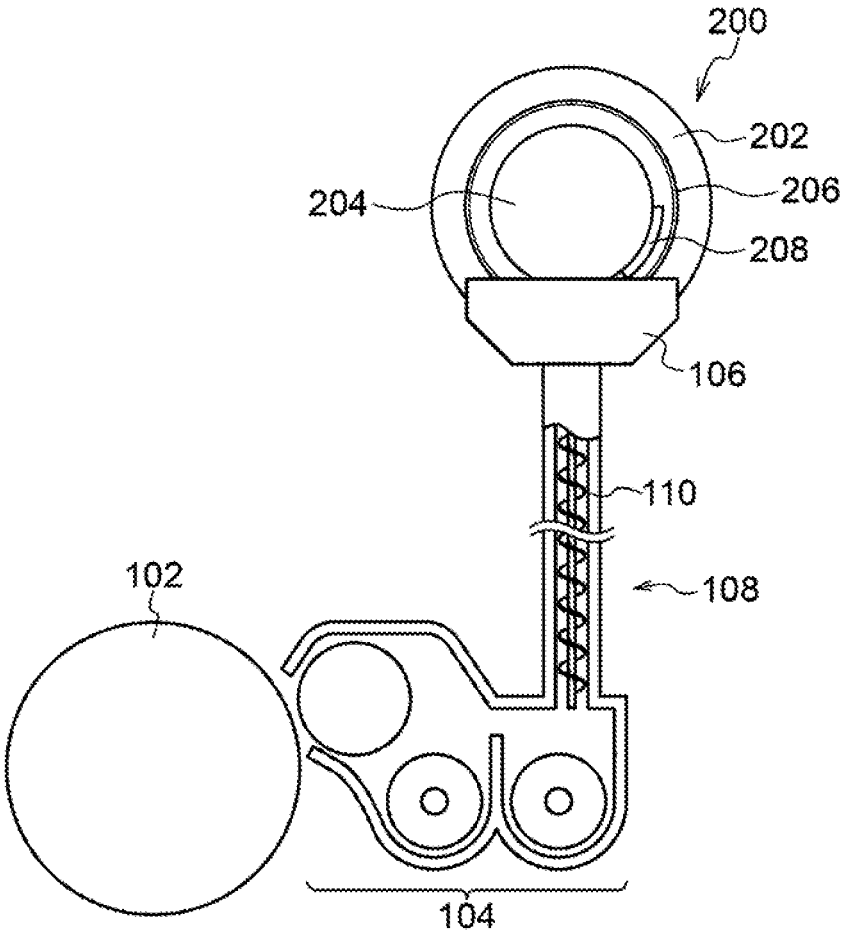
FIG. 2 is a schematic diagram illustrating examples of an image holding member, a developing unit, a toner supply pass, a replenishment toner container mounting unit, and a replenishment toner container that are included in an image forming apparatus according to an exemplary embodiment.

FIG. 2 is a schematic diagram illustrating examples of the image holding member, the developing unit, the toner supply pass, the replenishment toner container mounting unit, and the replenishment toner container included in the image forming apparatus according to the exemplary embodiment.

The example structure illustrated in FIG. 2 includes a photosensitive member 102 (example of the image holding member), a developing device 104 (example of the developing unit), a toner supply pass 108, a replenishment toner container mounting unit 106, and a replenishment toner container 200.

The inside of the developing device 104 is, for example, divided into two chambers with a partition member. One of the chambers is provided with an outlet of the toner supply pass 108 formed therein. The other chamber is provided with a developing roller arranged to face the photosensitive member 102. The two chambers are partially communicated with each other. Each of the chambers is provided with one stirring member disposed therein, which transports a developer while stirring the developer. The developer (not illustrated) included in the developing device 104 is transported and supplied to the developing roller while being stirred with the two stirring members.

One of the ends of the toner supply pass 108 is connected to the replenishment toner container mounting unit 106, and the other end is connected to the developing device 104. An auger screw 110 (example of a toner transport mechanism) is disposed inside the toner supply pass 108. The action of the auger screw 110 causes a toner to pass through the toner supply pass 108. The toner transport mechanism, such as an auger screw, is not necessarily disposed inside the toner supply pass 108; in the case where the toner transport mechanism is not disposed inside the toner supply pass 108, for example, a toner is passed through the toner supply pass 108 by free fall.

The replenishment toner container mounting unit 106 is a unit that enables the replenishment toner container 200 to be detachably attached to an image forming apparatus. The replenishment toner container mounting unit 106 includes a toner receiving port communicated with a toner discharge port of the replenishment toner container 200 and a rotation mechanism (e.g., gear) that rotates the replenishment toner container 200.

The replenishment toner container 200 includes the specific toner described below, which is stored inside the replenishment toner container 200 and supplied into the developing device 104 as a replenishment toner. The replenishment toner container 200 includes a bottle main body 202 (example of the toner accommodating portion), a lid 204, a gear 206, and a shutter 208 for closing and opening the toner discharge port.

The replenishment toner container 200 has a shape that enables the toner stored in the container to be discharged by rotation of the replenishment toner container 200. The replenishment toner container 200 includes, for example, a toner discharge port formed in one of the end faces of the container in the direction of the longer axis of the container and a continuous protrusion formed in the inner surface of the bottle main body 202 so as to extend toward the toner discharge port in a helical pattern. Specifically, the protrusion is, for example, a continuous protrusion that extends from the position around the bottom surface of the bottle main body 202 toward the lid 204 in a helical pattern. The protrusion is formed so as to be protruded when viewed from the inside of the bottle main body 202. Examples of the protrusion include a protrusion formed as a result of a part of the side surface of the bottle main body 202 being protruded toward the inside of the bottle main body 202; and a coiled member disposed directly on the inner surface of the bottle main body 202 so as to extend continuously from the position around the bottom surface of the bottle main body 202 toward the lid 204 in a helical pattern.

The replenishment toner container 200 is, for example, a toner cartridge. The specific structure and action of the replenishment toner container 200 are the same as those of the rotary toner bottle 200 described below.

The replenishment toner container 200 is attached to the replenishment toner container mounting unit 106 such that, for example, the longer axis of the replenishment toner container 200 extends in the horizontal direction. The rotation mechanism (e.g., a gear) included in the replenishment toner container mounting unit 106 rotates, for example, the replenishment toner container 200 about a horizontal axis.

The image forming apparatus includes a controller (not illustrated) that receives and sends information from and to various devices (i.e., units) and controls the operations of the devices (i.e., units). For example, the developing device 104 includes a developer amount detection unit (not illustrated). Upon the developer amount detection unit detecting the shortage of the developer, the controller (not illustrated) sends a signal to rotate the rotation mechanism (e.g., a gear) of the replenishment toner container mounting unit 106. When the rotation mechanism of the replenishment toner container mounting unit 106 is rotated, the replenishment toner container 200 is driven to rotate and a toner is discharged from the discharge port of the replenishment toner container 200. The toner discharged from the replenishment toner container 200 enters the toner supply pass 108 through the replenishment toner container mounting unit 106 and is then supplied into the developing device 104 through the toner supply pass 108. Furthermore, for example, a residual toner detection unit (not illustrated) is disposed inside the replenishment toner container 200. Upon the residual toner detection unit detecting the shortage of the toner that remains in the replenishment toner container 200, an instruction to replace the replenishment toner container 200 is displayed on a display (not illustrated).

The controller (not illustrated) is configured as a computer that controls the overall apparatus and performs various operations. Specifically, the controller includes, for example, a central processing unit (CPU), a read-only memory (ROM) that stores various programs, a random access memory (RAM) used as a work area during the execution of a program, a nonvolatile memory that stores various types of information, and an input-output interface (I/O) (all not illustrated). The CPU, the ROM, the RAM, the nonvolatile memory, and the I/O are connected to one another with a bus.

The image forming apparatus further includes, in addition to the controller, an operating display, an image processing unit, an image memory, a storage unit, a communication unit, etc. (all not illustrated). The operating display, the image processing unit, the image memory, the storage unit, and the communication unit are connected to the I/O of the controller. The controller (not illustrated) receives and sends information from and to the operating display, the image processing unit, the image memory, the storage unit, and the communication unit and controls these units.

Toner Cartridge

A toner cartridge according to the exemplary embodiment is a toner cartridge that includes the replenishment toner and is detachably attachable to an image forming apparatus. The toner cartridge is an example of the replenishment toner container that includes the replenishment toner that is to be supplied into the developing unit included in the image forming apparatus.

Figure 3:
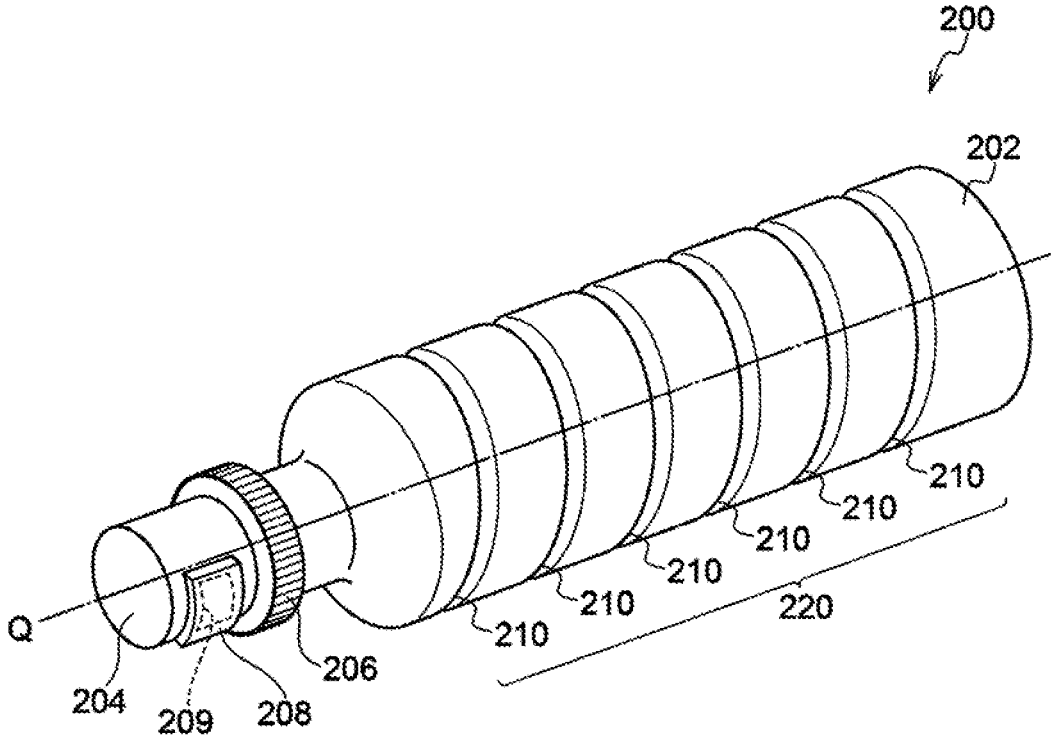
FIG. 3 is a schematic diagram illustrating an example of a toner cartridge according to an exemplary embodiment.

The toner cartridge according to the exemplary embodiment has a shape that enables a toner included in the toner cartridge to be discharged by rotation of the toner cartridge. An example of the toner cartridge according to the exemplary embodiment is a rotary toner cartridge that includes a rotatable toner accommodating portion that includes a toner. FIG. 3 is a schematic diagram illustrating a rotary toner bottle, which is an example of the rotary toner cartridge. The rotary toner bottle 200 illustrated in FIG. 3 includes a bottle main body 202, a lid 204, and a gear 206. The rotary toner bottle 200 is attached to, for example, the replenishment toner container mounting unit 106 illustrated in FIG. 2.

The bottle main body 202 is hollow cylindrical and includes a convexo-concavity portion 220 formed in the side surface, which is used for transporting the replenishment toner to the discharge port. A protrusion 210 formed in the convexo-concavity portion 220 extends continuously from the position around the bottom surface of the bottle main body 202 toward the lid 204 in a helical pattern. The protrusion 210 is formed so as to be protruded when viewed from the inside of the bottle main body 202. The protrusion 210 may be single helical or multi-helical. The portion interposed between two adjacent portions of the protrusion 210 appears as a recess when viewed from the inside of the bottle main body 202. The width of the protrusion 210 (i.e., the length of the protrusion 210 in the direction of the axis Q) is desirably smaller than the width of the adjacent recesses (i.e., the length of the recesses in the direction of the axis Q) in order to make it easy to transport the replenishment toner toward the lid 204 inside the bottle main body 202.

The bottle main body 202 is made of a resin or the like. Examples of the material constituting the bottle main body 202 include polyethylene terephthalate, a polyolefin, and a polyester. The bottle main body 202 and the gear 206 may be formed as a single piece. Alternatively, the bottle main body 202 and the gear 206 may be formed individually and subsequently joined with each other.

The lid 204 is disposed at one of the ends of the rotary toner bottle 200 in the direction of the axis Q. In the lid 204, a discharge port 209 through which the replenishment toner is discharged and a shutter 208 for closing and opening the discharge port 209 are formed. When the shutter 208 formed in the lid 204 is opened/closed, the discharge port 209 is opened/closed.

The gear 206 is a gear that engages with a driving gear included in the toner cartridge mounting unit of the image forming apparatus and is driven to rotate in accordance with the rotation of the driving gear when the rotary toner bottle 200 is attached to the toner cartridge mounting unit. The gear 206 is arranged concentrically with respect to the bottle main body 202. The gear 206 illustrated in FIG. 3 has a smaller outside diameter than the bottle main body 202. The outside diameter of the gear 206 may be equal to that of the bottle main body 202. The outside diameter of the gear 206 may be larger than that of the bottle main body 202.

Although the bottle main body 202 includes the convexo-concavity portion 220 in FIG. 3, the toner cartridge and the rotary toner bottle according to the exemplary embodiment are not limited to this. The side surface of the bottle main body 202 may be a smooth curved surface without any recesses when viewed from the outside of the bottle main body 202.

Although the protrusion 210 is formed as a part of the bottle main body 202 in FIG. 3, the toner cartridge and the rotary toner bottle according to the exemplary embodiment are not limited to this. The protrusion 210 and the bottle main body 202 may be formed as individual members. Examples of the individual member include a coiled member disposed directly on the inner surface of the bottle main body 202 so as to extend continuously from the position around the bottom surface of the bottle main body 202 toward the lid 204 in a helical pattern.

The width of the protrusion 210 (i.e., the length of the protrusion 210 in the direction of the axis Q) (the width of each portion of the protrusion and the average width of the protrusion) is preferably 2 mm or more and 10 mm or less and is more preferably 3 mm or more and 8 mm or less.

The height of the protrusion 210 (the height of each portion of the protrusion and the average height of the protrusion) is preferably 2 mm or more and 10 mm or less and is more preferably 3 mm or more and 8 mm or less.

The helical pitch of the protrusion 210 (i.e., the distance between two adjacent portions of the protrusion in the direction of the axis Q) (the helical pitch of each portion of the protrusion and the average helical pitch of the protrusion) is preferably 20 mm or more and 100 mm or less, is more preferably 30 mm or more and 90 mm or less, and is further preferably 40 mm or more and 80 mm or less.

The action taken when the rotary toner bottle 200 is attached to the toner cartridge mounting unit of the image forming apparatus is described below.

The rotary toner bottle 200 is attached to the toner cartridge mounting unit such that the gear 206 engages with the driving gear included in the toner cartridge mounting unit. Then, the shutter 208 is opened, and the rotary toner bottle 200 connects to the toner supply pass of the image forming apparatus through the discharge port 209. When the driving gear of the toner cartridge mounting unit is rotated, the gear 206 is driven to rotate. Consequently, the bottle main body 202 is driven to rotate about the axis Q. As a result of the rotation of the bottle main body 202, the replenishment toner is transported from the position around the bottom surface of the bottle main body 202 toward the lid 204 by the convexo-concavity portion 220. The replenishment toner transported toward the lid 204 is discharged through the discharge port 209 and supplied into the toner supply pass of the image forming apparatus. The rotary toner bottle 200 is attached to, for example, the toner cartridge mounting unit of the image forming apparatus such that the axis Q extends in the horizontal direction.

Replenishment Toner

Details of the replenishment toner used in the image forming apparatus and the toner cartridge according to the exemplary embodiment are described below. The toner may be used as a toner that is charged in the developing unit before replenishment.

The replenishment toner includes toner particles and silica particles having a number average particle size of 110 nm or more and 130 nm or less, a large-diameter-side number particle size distribution index (upper GSDp) of less than 1.080, and an average circularity of 0.94 or more and 0.98 or less, wherein 80 number % or more of the silica particles have a circularity of 0.92 or more.

Toner Particles

The toner particles include, for example, a binder resin and may optionally include a colorant, a release agent, and other additives.

Binder Resin

Examples of the binder resin include vinyl resins that are homopolymers of the following monomers or copolymers of two or more monomers selected from the following monomers: styrenes, such as styrene, para-chlorostyrene, and α-methylstyrene; (meth)acrylates, such as methyl acrylate, ethyl acrylate, n-propyl acrylate, n-butyl acrylate, lauryl acrylate, 2-ethylhexyl acrylate, methyl methacrylate, ethyl methacrylate, n-propyl methacrylate, lauryl methacrylate, and 2-ethylhexyl methacrylate; ethylenically unsaturated nitriles, such as acrylonitrile and methacrylonitrile; vinyl ethers, such as vinyl methyl ether and vinyl isobutyl ether; vinyl ketones, such as vinyl methyl ketone, vinyl ethyl ketone, and vinyl isopropenyl ketone; and olefins, such as ethylene, propylene, and butadiene.

Examples of the binder resin further include non-vinyl resins, such as epoxy resins, polyester resins, polyurethane resins, polyamide resins, cellulose resins, polyether resins, and modified rosins; a mixture of the non-vinyl resin and the vinyl resin; and a graft polymer produced by polymerization of the vinyl monomer in the presence of the non-vinyl resin.

The above binder resins may be used alone or in combination of two or more.

(1) Styrene Acrylic Resin

The binder resin may be a styrene acrylic resin.

A styrene acrylic resin is a copolymer produced by copolymerization of at least a monomer including a styrene skeleton (hereinafter, referred to as "styrene-based monomer") with a monomer that includes a (meth)acryloyl group and preferably includes a (meth)acryloyloxy group (hereinafter, referred to as "(meth)acryl-based monomer"). The styrene acrylic resin includes, for example, a copolymer of a monomer selected from the styrenes with a monomer selected from the above-described (meth)acrylate esters. The acrylic resin portion of the styrene acrylic resin is a structural unit produced by polymerization of an acryl-based monomer, a methacryl-based monomer, or both acryl-based monomer and methacryl-based monomer. The term "(meth) acryl" used herein refers to both "acryl" and "methacryl".

Specific examples of the styrene-based monomer include styrene; alkyl-substituted styrenes, such as α-methylstyrene, 2-methylstyrene, 3-methylstyrene, 4-methylstyrene, 2-ethylstyrene, 3-ethylstyrene, and 4-ethylstyrene; halogen-substituted styrenes, such as 2-chlorostyrene, 3-chlorostyrene, and 4-chlorostyrene; and vinylnaphthalene. The above styrene-based monomers may be used alone or in combination of two or more.

Among these styrene-based monomers, styrene is preferable in terms of ease of reaction, ease of controlling reaction, and ease of availability.

Specific examples of the (meth)acryl-based monomer include (meth)acrylic acid and (meth)acrylate esters. Examples of the (meth)acrylate esters include alkyl (meth) acrylate esters, such as methyl (meth)acrylate, ethyl (meth) acrylate, n-propyl (meth)acrylate, n-butyl (meth)acrylate, n-pentyl (meth)acrylate, n-hexyl acrylate, n-heptyl (meth) acrylate, n-octyl (meth)acrylate, n-decyl (meth)acrylate, n-dodecyl (meth)acrylate, n-lauryl (meth) acrylate, n-tetradecyl (meth) acrylate, n-hexadecyl (meth) acrylate, n-octadecyl (meth) acrylate, isopropyl (meth)acrylate, isobutyl (meth)acrylate, t-butyl (meth)acrylate, isopentyl (meth) acrylate, amyl (meth)acrylate, neopentyl (meth)acrylate, isohexyl (meth)acrylate, isoheptyl (meth)acrylate, isooctyl (meth) acrylate, 2-ethylhexyl (meth) acrylate, cyclohexyl (meth)acrylate, and t-butylcyclohexyl (meth)acrylate); aryl (meth)acrylate esters, such as phenyl (meth)acrylate, biphenyl (meth)acrylate, diphenylethyl (meth)acrylate, t-butylphenyl (meth)acrylate, and terphenyl (meth)acrylate; dimethylaminoethyl (meth) acrylate; diethylaminoethyl (meth) acrylate; methoxyethyl (meth) acrylate; 2-hydroxyethyl (meth)acrylate; β-carboxyethyl (meth)acrylate; and (meth)acrylamide. The above (meth)acryl-based monomers may be used alone or in combination of two or more.

Among the above (meth)acrylate esters, a (meth)acrylate ester including an alkyl group having 2 to 14 carbon atoms, preferably having 2 to 10 carbon atoms, and more preferably having 3 to 8 carbon atoms is preferable in order to enhance the fixability of the toner. In particular, n-butyl (meth) acrylate is preferable, and n-butyl acrylate is particularly preferable.

The copolymerization ratio between the styrene-based monomer and the (meth)acryl-based monomer (by mass, [Styrene-based monomer]/[(Meth)acryl-based monomer]) may be, but not limited to, 85/15 to 60/40.

The styrene acrylic resin may include a crosslinked structure. The styrene acrylic resin including a crosslinked structure is, for example, a copolymer of at least the styrene-based monomer, the (meth)acryl-based monomer, and a crosslinkable monomer.

Examples of the crosslinkable monomer include crosslinking agents having two or more functional groups.

Examples of the difunctional crosslinking agent include divinylbenzene; divinylnaphthalene; di(meth)acrylates, such as diethylene glycol di(meth)acrylate, methylene bis (meth)acrylamide, decanediol diacrylate, and glycidyl (meth)acrylate; polyester di(meth)acrylate; and 2-([1'-methylpropylideneamino]carboxyamino)ethyl methacrylate.

Examples of the crosslinking agents having three or more functional groups include tri(meth)acrylates, such as pentaerythritol tri(meth)acrylate, trimethylolethane tri(meth) acrylate, and trimethylolpropane tri(meth)acrylate; tetra(meth)acrylates, such as pentaerythritol tetra(meth)acrylate and oligoester (meth)acrylate; 2,2-bis(4-methacryloxy polyethoxyphenyl)propane; diallyl phthalate; triallyl cyanurate; triallyl isocyanurate; triallyl trimellitate; and diallyl chlorendate.

Among the above crosslinkable monomers, in order to enhance the fixability of the toner, a (meth)acrylate having two or more functional groups is preferable, a difunctional (meth)acrylate is more preferable, a difunctional (meth) acrylate including an alkylene group having 6 to 20 carbon atoms is further preferable, and a difunctional (meth)acrylate including a linear alkylene group having 6 to 20 carbon atoms is particularly preferable.

The copolymerization ratio of the crosslinkable monomer to all the monomers (by mass, [Crosslinkable monomer]/[All monomers]) may be, but not limited to, 2/1,000 to 20/1,000.

The glass transition temperature (Tg) of the styrene acrylic resin is preferably 40° C. or more and 75° C. or less and is more preferably 50° C. or more and 65° C. or less in order to enhance the fixability of the toner.

Glass transition temperature is determined from a differential scanning calorimetry (DSC) curve obtained by DSC. More specifically, the glass transition temperature is determined from the "extrapolated glass-transition-starting temperature" according to a method for determining glass transition temperature which is described in JIS K 7121-1987 "Testing Methods for Transition Temperatures of Plastics".

The weight average molecular weight of the styrene acrylic resin is preferably 5,000 or more and 200,000 or less, is more preferably 10,000 or more and 100,000 or less, and is particularly preferably 20,000 or more and 80,000 or less in order to enhance the preservation stability of the toner.

The method for preparing the styrene acrylic resin is not limited; various polymerization methods, such as solution polymerization, precipitation polymerization, suspension polymerization, bulk polymerization, and emulsion polymerization, may be used. The polymerization reaction may be conducted by any suitable process known in the related art, such as a batch process, a semi-continuous process, or a continuous process.

(2) Polyester Resin

The binder resin may be a polyester resin.

Examples of the polyester resin include amorphous polyester resins known in the related art. A crystalline polyester resin may be used as a polyester resin in combination with an amorphous polyester resin. In such a case, the content of the crystalline polyester resin in the binder resin may be 2% by mass or more and 40% by mass or less and is preferably 2% by mass or more and 20% by mass or less.

The term "crystalline" resin used herein refers to a resin that, in thermal analysis using differential scanning calorimetry (DSC), exhibits a distinct endothermic peak instead of step-like endothermic change and specifically refers to a resin that exhibits an endothermic peak with a half-width of 10° C. or less at a heating rate of 10° C./min.

On the other hand, the term "amorphous" resin used herein refers to a resin that exhibits an endothermic peak with a half-width of more than 10° C., that exhibits step-like endothermic change, or that does not exhibit a distinct endothermic peak.

Amorphous Polyester Resin

Examples of the amorphous polyester resin include condensation polymers of a polyvalent carboxylic acid and a polyhydric alcohol. The amorphous polyester resin may be a commercially available one or a synthesized one.

Examples of the polyvalent carboxylic acid include aliphatic dicarboxylic acids, such as oxalic acid, malonic acid, maleic acid, fumaric acid, citraconic acid, itaconic acid, glutaconic acid, succinic acid, alkenyl succinic acid, adipic acid, and sebacic acid; alicyclic dicarboxylic acids, such as cyclohexanedicarboxylic acid; aromatic dicarboxylic acids, such as terephthalic acid, isophthalic acid, phthalic acid, and naphthalenedicarboxylic acid; anhydrides of these dicarboxylic acids; and lower (e.g., 1 to 5 carbon atoms) alkyl esters of these dicarboxylic acids. Among these dicarboxylic acids, for example, aromatic dicarboxylic acids may be used as a polyvalent carboxylic acid.

Trivalent or higher carboxylic acids having a crosslinked structure or a branched structure may be used as a polyvalent carboxylic acid in combination with the dicarboxylic acids. Examples of the trivalent or higher carboxylic acids include trimellitic acid, pyromellitic acid, anhydrides of these carboxylic acids, and lower (e.g., 1 to 5 carbon atoms) alkyl esters of these carboxylic acids.

The above polyvalent carboxylic acids may be used alone or in combination of two or more.

Examples of the polyhydric alcohol include aliphatic diols, such as ethylene glycol, diethylene glycol, triethylene glycol, propylene glycol, butanediol, hexanediol, and neopentyl glycol; alicyclic diols, such as cyclohexanediol, cyclohexanedimethanol, and hydrogenated bisphenol A; and aromatic diols, such as bisphenol A-ethylene oxide adducts and bisphenol A-propylene oxide adducts. Among these diols, for example, aromatic diols and alicyclic diols may be used as a polyhydric alcohol. In particular, aromatic diols may be used as a polyhydric alcohol.

Trihydric or higher alcohols having a crosslinked structure or a branched structure may be used as a polyhydric alcohol in combination with the diols. Examples of the trihydric or higher alcohols include glycerin, trimethylolpropane, and pentaerythritol.

The above polyhydric alcohols may be used alone or in combination of two or more.

The glass transition temperature Tg of the amorphous polyester resin is preferably 50° C. or more and 80° C. or less and is more preferably 50° C. or more and 65° C. or less.

The glass transition temperature is determined from a DSC curve obtained by differential scanning calorimetry (DSC). More specifically, the glass transition temperature is determined from the "extrapolated glass-transition-starting temperature" according to a method for determining glass transition temperature which is described in JIS K 7121-1987 "Testing Methods for Transition Temperatures of Plastics".

The weight average molecular weight Mw of the amorphous polyester resin is preferably 5,000 or more and 1,000,000 or less and is more preferably 7,000 or more and 500,000 or less.

The number average molecular weight Mn of the amorphous polyester resin is preferably 2,000 or more and 100,000 or less.

The molecular weight distribution index Mw/Mn of the amorphous polyester resin is preferably 1.5 or more and 100 or less and is more preferably 2 or more and 60 or less.

The weight average molecular weight and number average molecular weight of the amorphous polyester resin are determined by gel permeation chromatography (GPC). Specifically, the molecular weights of the amorphous polyester resin are determined by GPC using a "HLC-8120GPC" produced by Tosoh Corporation as measuring equipment, a column "TSKgel SuperHM-M (15 cm)" produced by Tosoh Corporation, and a tetrahydrofuran (THF) solvent. The weight average molecular weight and number average molecular weight of the amorphous polyester resin are determined on the basis of the results of the measurement using a molecular weight calibration curve based on monodisperse polystyrene standard samples.

The amorphous polyester resin may be produced by any suitable production method known in the related art. Specifically, the amorphous polyester resin may be produced by, for example, a method in which polymerization is performed at 180° C. or more and 230° C. or less, the pressure inside the reaction system is reduced as needed, and water and alcohols that are generated by condensation are removed.

In the case where the raw materials, that is, the monomers, are not dissolved in or miscible with each other at the reaction temperature, a solvent having a high boiling point may be used as a dissolution adjuvant in order to dissolve the raw materials. In such a case, the condensation polymerization reaction is performed while the dissolution adjuvant is distilled away. In the case where the monomers have low miscibility with each other, a condensation reaction of the monomers with an acid or alcohol that is to undergo a polycondensation reaction with the monomers may be performed in advance and subsequently polycondensation of the resulting polymers with the other components may be performed.

Crystalline Polyester Resin

Examples of the crystalline polyester resin include condensation polymers of a polyvalent carboxylic acid and a polyhydric alcohol. The crystalline polyester resin may be commercially available one or a synthesized one.

In order to increase ease of forming a crystal structure, a condensation polymer prepared from linear aliphatic polymerizable monomers may be used as a crystalline polyester resin instead of a condensation polymer prepared from aromatic polymerizable monomers.

Examples of the polyvalent carboxylic acid include aliphatic dicarboxylic acids, such as oxalic acid, succinic acid, glutaric acid, adipic acid, suberic acid, azelaic acid, sebacic acid, 1,9-nonanedicarboxylic acid, 1,10-decanedicarboxylic acid, 1,12-dodecanedicarboxylic acid, 1,14-tetradecanedicarboxylic acid, and 1,18-octadecanedicarboxylic acid; aromatic dicarboxylic acids, such as dibasic acids (e.g., phthalic acid, isophthalic acid, terephthalic acid, and naphthalene-2,6-dicarboxylic acid); anhydrides of these dicarboxylic acids; and lower (e.g., 1 to 5 carbon atoms) alkyl esters of these dicarboxylic acids.

Trivalent or higher carboxylic acids having a crosslinked structure or a branched structure may be used as a polyvalent carboxylic acid in combination with the dicarboxylic acids.

Examples of the trivalent carboxylic acids include aromatic carboxylic acids, such as 1,2,3-benzenetricarboxylic acid, 1,2,4-benzenetricarboxylic acid, and 1,2,4-naphthalenetricarboxylic acid; anhydrides of these tricarboxylic acids; and lower (e.g., 1 to 5 carbon atoms) alkyl esters of these tricarboxylic acids.

Dicarboxylic acids including a sulfonic group and dicarboxylic acids including an ethylenic double bond may be used as a polyvalent carboxylic acid in combination with the above dicarboxylic acids.

The above polyvalent carboxylic acids may be used alone or in combination of two or more.

Examples of the polyhydric alcohol include aliphatic diols, such as linear aliphatic diols including a backbone having 7 to 20 carbon atoms. Examples of the aliphatic diols include ethylene glycol, 1,3-propanediol, 1,4-butanediol, 1,5-pentanediol, 1,6-hexanediol, 1,7-heptanediol, 1,8-octanediol, 1,9-nonanediol, 1,10-decanediol, 1,11-undecanediol, 1,12-dodecanediol, 1,13-tridecanediol, 1,14-tetradecanediol, 1,18-octadecanediol, and 1,14-eicosanedecanediol. Among these aliphatic diols, 1,8-octanediol, 1,9-nonanediol, and 1,10-decanediol may be used.

Trihydric or higher alcohols having a crosslinked structure or a branched structure may be used as a polyhydric alcohol in combination with the above diols. Examples of the trihydric or higher alcohols include glycerin, trimethylolethane, trimethylolpropane, and pentaerythritol.

The above polyhydric alcohols may be used alone or in combination of two or more.

The content of the aliphatic diols in the polyhydric alcohol may be 80 mol % or more and is preferably 90 mol % or more.

The melting temperature of the crystalline polyester resin is preferably 50° C. or more and 100° C. or less, is more preferably 55° C. or more and 90° C. or less, and is further preferably 60° C. or more and 85° C. or less.

The melting temperature of the crystalline polyester resin is determined from the "melting peak temperature" according to a method for determining melting temperature which is described in JIS K 7121-1987 "Testing Methods for Transition Temperatures of Plastics" using a DSC curve obtained by differential scanning calorimetry (DSC).

The crystalline polyester resin may have a weight average molecular weight Mw of 6,000 or more and 35,000 or less.

The crystalline polyester resin may be produced by any suitable method known in the related art similarly to, for example, the amorphous polyester resin.

The content of the binder resin in the toner particles is preferably, for example, 40% by mass or more and 95% by mass or less, is more preferably 50% by mass or more and 90% by mass or less, and is further preferably 60% by mass or more and 85% by mass or less.

Colorant

Examples of the colorant include various pigments, such as Carbon Black, Chrome Yellow, Hansa Yellow, Benzidine Yellow, Threne Yellow, Quinoline Yellow, Pigment Yellow, Permanent Orange GTR, Pyrazolone Orange, Vulcan Orange, Watching Red, Permanent Red, Brilliant Carmine 3B, Brilliant Carmine 6B, DuPont Oil Red, Pyrazolone Red, Lithol Red, Rhodamine B Lake, Lake Red C, Pigment Red, Rose Bengal, Aniline Blue, Ultramarine Blue, Calco Oil Blue, Methylene Blue Chloride, Phthalocyanine Blue, Pigment Blue, Phthalocyanine Green, and Malachite Green Oxalate; and various dyes, such as acridine dyes, xanthene dyes, azo dyes, benzoquinone dyes, azine dyes, anthraquinone dyes, thioindigo dyes, dioxazine dyes, thiazine dyes, azomethine dyes, indigo dyes, phthalocyanine dyes, aniline black dyes, polymethine dyes, triphenylmethane dyes, diphenylmethane dyes, and thiazole dyes.

The above colorants may be used alone or in combination of two or more.

The colorant may optionally be subjected to a surface treatment and may be used in combination with a dispersant. Plural types of colorants may be used in combination.

The content of the colorant in the toner particles is preferably, for example, 1% by mass or more and 30% by mass or less and is more preferably 3% by mass or more and 15% by mass or less.

Release Agent

Examples of the release agent include, but are not limited to, hydrocarbon waxes; natural waxes, such as a carnauba wax, a rice bran wax, and a candelilla wax; synthetic or mineral-petroleum-derived waxes, such as a montan wax; and ester waxes, such as a fatty-acid ester wax and a montanate wax.

The melting temperature of the release agent is preferably 50° C. or more and 110° C. or less and is more preferably 60° C. or more and 100° C. or less.

The melting temperature of the release agent is determined from the "melting peak temperature" according to a method for determining melting temperature which is described in JIS K 7121-1987 "Testing Methods for Transition Temperatures of Plastics" using a DSC curve obtained by differential scanning calorimetry (DSC).

The content of the release agent in the toner particles is preferably, for example, 1% by mass or more and 20% by mass or less and is more preferably 5% by mass or more and 15% by mass or less.

Other Additives

Examples of the other additives include additives known in the related art, such as a magnetic substance, a charge-controlling agent, and an inorganic powder. These additives may be added to the toner particles as internal additives.

Properties, Etc. of Toner Particles

The toner particles may have a single-layer structure or a "core-shell" structure constituted by a core (i.e., core particle) and a coating layer (i.e., shell layer) covering the core.

The core-shell structure of the toner particles may be constituted by, for example, a core including a binder resin and, as needed, other additives such as a colorant and a release agent and by a coating layer including the binder resin.

The volume average diameter D50v of the toner particles is preferably 2 μm or more and 10 μm or less and is more preferably 4 μm or more and 8 μm or less.

The above-described average diameters and particle diameter distribution indices of the toner particles are measured using "COULTER MULTISIZER II" (produced by Beckman Coulter, Inc.) with an electrolyte "ISOTON-II" (produced by Beckman Coulter, Inc.) in the following manner.

A sample to be measured (0.5 mg or more and 50 mg or less) is added to 2 ml of a 5%-aqueous solution of a surfactant (e.g., sodium alkylbenzene sulfonate) that serves as a dispersant. The resulting mixture is added to 100 ml or more and 150 ml or less of an electrolyte.

The resulting electrolyte containing the sample suspended therein is subjected to a dispersion treatment for 1 minute using an ultrasonic disperser, and the distribution of the diameters of particles having a diameter of 2 μm or more and 60 μm or less is measured using COULTER MULTISIZER II with an aperture having a diameter of 100 μm. The number of the particles sampled is 50,000.

The particle diameter distribution measured is divided into a number of particle diameter ranges (i.e., channels). For each range, in ascending order in terms of particle diameter, the cumulative volume and the cumulative number are calculated and plotted to draw cumulative distribution curves. Particle diameters at which the cumulative volume and the cumulative number reach 16% are considered to be the volume particle diameter D16v and the number particle diameter D16p, respectively. Particle diameters at which the cumulative volume and the cumulative number reach 50% are considered to be the volume average particle diameter D50v and the number average particle diameter D50p, respectively. Particle diameters at which the cumulative volume and the cumulative number reach 84% are considered to be the volume particle diameter D84v and the number particle diameter D84p, respectively.

Using the volume particle diameters and number particle diameters measured, the volume particle size distribution index (GSDv) is calculated as $(D84v/D16v)^{1/2}$ and the number particle size distribution index (GSDp) is calculated as $(D84p/D16p)^{1/2}$.

The toner particles preferably have an average circularity of 0.94 or more and 1.00 or less. The average circularity of the toner particles is more preferably 0.95 or more and 0.98 or less.

The average circularity of the toner particles is determined as [Equivalent circle perimeter]/[Perimeter] (i.e., [Perimeter of a circle having the same projection area as the particles]/[Perimeter of the projection image of the particles]. Specifically, the average circularity of the toner particles is determined by the following method.

The toner particles to be measured are sampled by suction so as to form a flat stream. A static image of the particles is taken by instantaneously flashing a strobe light. The image of the particles is analyzed with a flow particle image analyzer "FPIA-3000" produced by Sysmex Corporation. The number of samples used for determining the average circularity of the toner particles is 3,500.

In the case where the toner includes an external additive, the toner (i.e., the developer) to be measured is dispersed in water containing a surfactant and then subjected to an ultrasonic wave treatment in order to remove the external additive from the toner particles.

First Silica Particles

The replenishment toner includes silica particles having a number average particle size of 110 nm or more and 130 nm or less, a large-diameter-side number particle size distribution index (upper GSDp) of less than 1.080, and an average circularity of 0.94 or more and 0.98 or less, wherein 80 number % or more of the silica particles have a circularity of 0.92 or more. Hereinafter, such silica particles are referred to as "first silica particles".

The number average particle size of the first silica particles is 110 nm or more and 130 nm or less. The number average particle size of the first silica particles is preferably 113 nm or more and 127 nm or less and is more preferably 115 nm or more and 125 nm or less in order to reduce the occurrence of fog in a low temperature, low humidity environment and limit a reduction in image density which may occur in a high temperature, high humidity environment.

The method for controlling the number average particle size of the first silica particles to fall within the above range is not limited. The number average particle size of the first silica particles may be controlled by, for example, using sol gel silica particles as first silica particles and adjusting the temperature at which an alkali catalyst and tetraalkoxysilane are mixed in the production of the sol gel silica particles or the amount of time during which the reaction is conducted. Alternatively, the concentrations of the alkali catalyst and tetraalkoxysilane may be adjusted.

The large-diameter-side number particle size distribution index (upper GSDp) of the first silica particles is less than 1.080. The upper GSDp of the first silica particles is preferably less than 1.077 and is more preferably less than 1.075 in order to reduce the occurrence of fog in a low temperature, low humidity environment and limit a reduction in image density which may occur in a high temperature, high humidity environment.

The small-diameter-side number particle size distribution index (lower GSDp) of the first silica particles is preferably less than 1.080, is more preferably less than 1.077, and is further preferably less than 1.075 in order to reduce the occurrence of fog in a low temperature, low humidity environment and limit a reduction in image density which may occur in a high temperature, high humidity environment.

The method for controlling the upper GSDp and lower GSDp of the first silica particles to fall within the above ranges is not limited. The upper GSDp and lower GSDp of the first silica particles may be controlled by, for example, using sol gel silica particles as first silica particles and adjusting the temperature at which an alkali catalyst and tetraalkoxysilane are mixed in the production of the sol gel silica particles or the amount of time during which the reaction is conducted. Alternatively, the concentrations of the alkali catalyst and tetraalkoxysilane may be adjusted.

The number average particle size, the upper GSDp, and the lower GSDp of the first silica particles are determined in the following manner.

(1) The toner is dispersed in methanol. After the resulting dispersion liquid has been stirred at room temperature (23° C.), the dispersion liquid is subjected to an ultrasonic bath in order to separate the external additive from the toner. Subsequently, centrifugal separation is performed to precipitate toner particles and collect a dispersion liquid containing the external additive dispersed therein. Then, methanol is removed by distillation and the external additive is extracted.

(2) The external additive is dispersed on the surface of the resin particle having a volume average particle size of 100 μm (polyester particles, weight average molecular weight Mw: 50,000).

(3) The resin particle on which the external additive is dispersed is observed with a scanning electron microscope (SEM) "S-4800" produced by Hitachi High-Technologies Corporation equipped with an energy dispersive X-ray (EDX) analyzer "EMAX Evolution X-Max 80=[2]" produced by HORIBA, Ltd. An image of the external additive is taken at a 40,000-fold magnification. Then, by EDX analysis, on the basis of the presence of Si, 300 or more primary particles of silica are identified in one field of view. The SEM observation is conducted with an accelerating voltage of 15 kV, an emission current of 20 μA, and a WD of 15 mm. The EDX analysis is conducted under the same conditions as above for a detection time of 60 minutes.

(4) The resulting image is captured into an image processor "LUZEXIII" produced by NIRECO CORPORATION. The area of each particle is measured by image analysis.

(5) The size of each silica particle is calculated on the basis of the area calculated above in terms of equivalent circle diameter.

(6) 100 silica particles having an equivalent circle diameter of 80 nm or more are selected.

For the selected silica particles, a cumulative distribution curve is drawn in ascending order in terms of equivalent circle diameter. The particle size at which the cumulative number reaches 50% is considered the number average particle size of the first silica particles.

For the selected silica particles, a cumulative distribution curve is drawn in ascending order in terms of equivalent circle diameter. The particle size at which the cumulative number reaches 16% is considered the number particle size D16p. The particle size at which the cumulative number reaches 50% is considered the number average particle size D50p. The particle size at which the cumulative number reaches 84% is considered the number particle size D84p. The large-diameter-side number particle size distribution index (upper GSDp) is calculated as $(D84p/D50p)^{1/2}$. The small-diameter-side number particle size distribution index (lower GSDp) is calculated as $(D50p/D16p)^{1/2}$.

The average circularity of the first silica particles is 0.94 or more and 0.98 or less. The average circularity of the first silica particles is preferably 0.940 or more and 0.980 or less, is more preferably 0.945 or more and 0.975 or less, and is further preferably 0.950 or more and 0.970 or less in order to reduce the occurrence of fog in a low temperature, low humidity environment and limit a reduction in image density which may occur in a high temperature, high humidity environment.

The method for controlling the average circularity of the first silica particles to fall within the above range is not limited. The average circularity of the first silica particles may be controlled by, for example, using sol gel silica particles as first silica particles and adjusting the temperature at which an alkali catalyst and tetraalkoxysilane are mixed in the production of the sol gel silica particles or the amount of time during which the reaction is conducted. Alternatively, the concentration of the alkali catalyst may be adjusted.

The proportion of the first silica particles having a circularity of 0.92 or more is 80 number % or more. The proportion of the first silica particles having a circularity of 0.92 or more is preferably 85 number % or more and is more preferably 87 number % or more in order to reduce the occurrence of fog in a low temperature, low humidity environment and limit a reduction in image density which may occur in a high temperature, high humidity environment.

The method for controlling the proportion of the first silica particles having a circularity of 0.92 or more to fall within the above range is not limited. The proportion of the first silica particles having a circularity of 0.92 or more may be controlled by, for example, using sol gel silica particles as first silica particles and adjusting the temperature at which an alkali catalyst and tetraalkoxysilane are mixed in the production of the sol gel silica particles or the amount of time during which the reaction is conducted. Alternatively, the concentration of the alkali catalyst may be adjusted.

The average circularity of the first silica particles and the proportion of the first silica particles having a circularity of 0.92 or more are determined in the following manner.

The circularity of each of the 100 silica particles selected in the measurement of the number average particle size of the first silica particles, which is described above, is calculated using Formula (1) below. The circularity at which the frequency calculated in ascending order in terms of circularity reaches 50% is considered the average circularity of the first silica particles.

$$\text{Circularity}=4\pi\times(A/I^2) \quad (1)$$

where I represents the perimeter of a primary particle on the image; and A represents the projected area of the primary particle on the image.

The number proportion of silica particles having a circularity of 0.92 or more in the 100 silica particles used in the calculation of average circularity is considered the number proportion of the first silica particles having a circularity of 0.92 or more.

The degree of hydrophobicity of the first silica particles is preferably 50% or more and 80% or less, is more preferably 50% or more and 75% or less, and is further preferably 50% or more and 70% or less in order to reduce the occurrence of fog in a low temperature, low humidity environment and limit a reduction in image density which may occur in a high temperature, high humidity environment.

The method for controlling the degree of hydrophobicity of the first silica particles to fall within the above range is not limited. The degree of hydrophobicity of the first silica particles may be controlled by, for example, using sol gel silica particles as first silica particles and, in the production of the sol gel silica particles, subjecting the surfaces of the silica particles to a hydrophobic treatment using a hydrophobizing agent in the presence of supercritical carbon dioxide.

The degree of hydrophobicity of the first silica particles is determined in the following manner.

To 50 ml of ion-exchange water, 0.2% by mass of the sample, that is, the silica particles, is added. While the resulting mixture is stirred with a magnetic stirrer, methanol is added dropwise from a buret to the mixture. The mass fraction (%) of methanol in the methanol-ion exchange water mixed solution (=Amount of methanol added/[Amount of methanol added+Amount of ion-exchange water]) measured at the endpoint at which the whole amount of the sample settles in the solution is considered the degree of hydrophobicity (%).

The first silica particles may be any particles composed primarily of silica, that is, $SiO_2$, and may be either crystalline or amorphous. The first silica particles may be particles produced using a silicon compound, such as water glass or alkoxysilane, as a raw material and may be particles produced by pulverizing quartz. Examples of the first silica particles include sol gel silica particles; aqueous colloidal silica particles; alcoholic silica particles; fumed silica particles produced by a gas phase method or the like; and fused silica particles. Among the above silica particles, sol gel silica particles are preferably included in the first silica particles.

Sol gel silica particles may be produced by, for example, the following method. Tetraalkoxysilane (e.g., TMOS) is added dropwise to an alkali catalyst solution containing an alcohol compound and ammonia water to cause hydrolysis and condensation of tetraalkoxysilane and form a suspension containing sol gel silica particles. The solvent is removed from the suspension to obtain particulate matter. The particulate matter is dried to form sol gel silica particles.

The first silica particles may be silica particles hydrophobized with a hydrophobizing agent.

Examples of the hydrophobizing agent include publicly known organic silicon compounds including an alkyl group, such as a methyl group, an ethyl group, a propyl group, or a butyl group. Specific examples thereof include an alkoxysilane compound, a siloxane compound, and a silazane compound. Among these, at least one of the siloxane compound and the silazane compound is preferably included in the hydrophobizing agent. The hydrophobizing agents may be used alone or in combination of two or more.

Examples of the siloxane compound include a silicone oil and a silicone resin. The silicone oil may include a dimethyl silicone oil. The above siloxane compounds may be used alone or in combination of two or more.

Examples of the silazane compound include hexamethyldisilazane and tetramethyldisilazane. In particular, hexamethyldisilazane (HMDS) is preferably included in the silazane compound. The above silazane compounds may be used alone or in combination of two or more.

The amount of the hydrophobizing agent, such as the silazane compound, deposited on the surfaces of the first silica particles is preferably 0.01% by mass or more and 5% by mass or less, is more preferably 0.05% by mass or more and 3% by mass or less, and is further preferably 0.10% by mass or more and 2% by mass or less of the amount of the first silica particles in order to increase the degree of hydrophobicity of the first silica particles.

For performing the hydrophobic treatment of the first silica particles with the hydrophobizing agent, for example, the following methods may be used: a method in which the hydrophobizing agent is dissolved in supercritical carbon dioxide and thereby applied to the surfaces of the silica particles; a method in which a solution containing the hydrophobizing agent and a solvent in which the hydrophobizing agent is soluble is applied to the surfaces of the silica particles by spraying, coating, or the like in the atmosphere in order to apply the hydrophobizing agent onto the surfaces of the silica particles; and a method in which a solution containing the hydrophobizing agent and a solvent in which the hydrophobizing agent is soluble is added to a silica particle dispersion liquid in the atmosphere and, after holding has been performed, the mixed solution of the silica particle dispersion liquid and the above solution is dried.

Other External Additive

The replenishment toner may further include an external additive other than the first silica particles. Hereinafter, such an external additive is referred to simply as "another external additive". Examples of the other external additive include inorganic oxide particles. Examples of the inorganic oxide particles include $SiO_2$ particles, $TiO_2$ particles, $Al_2O_3$ particles, CuO particles, ZnO particles, $SnO_2$ particles, $CeO_2$ particles, $Fe_2O_3$ particles, MgO particles, BaO particles, CaO particles, $K_2O$ particles, $Na_2O$ particles, $ZrO_2$ particles, CaO—$SiO_2$ particles, $K_2O.(TiO_2)_n$ particles, $Al_2O_3.2SiO_2$ particles, $CaCO_3$ particles, $MgCO_3$ particles, $BaSO_4$ particles, and $MgSO_4$ particles. Among the above inorganic oxide particles, $TiO_2$ and $SiO_2$ particles, that is, titania particles and silica particles (hereinafter, referred to as "second silica particles"), are preferably used.

The number average particle size of the inorganic oxide particles is preferably 5 nm or more and 50 nm or less and is more preferably 10 nm or more and 40 nm or less in order to enhance the flowability of the toner.

The number average particle size of the inorganic oxide particles is determined in the following manner.

(1) The toner is dispersed in methanol. After the resulting dispersion liquid has been stirred at room temperature (23° C.), the dispersion liquid is subjected to an ultrasonic bath in order to separate the external additive from the toner. Subsequently, centrifugal separation is performed to precipitate toner particles and collect a dispersion liquid containing the external additive dispersed therein. Then, methanol is removed by distillation and the external additive is extracted.

(2) The external additive is dispersed in resin particles having a volume average particle size of 100 μm (polyester particles, weight average molecular weight Mw: 50,000).

(3) The resin particles in which the external additive is dispersed are observed with a scanning electron microscope (SEM) "S-4800" produced by Hitachi High-Technologies Corporation equipped with an energy dispersive X-ray (EDX) analyzer "EMAX Evolution X-Max 80=2" produced by HORIBA, Ltd. An image of the external additive is taken at a 40,000-fold magnification. Then, by EDX analysis, on the basis of the presence of the atom (e.g., Si or Ti) included in the inorganic oxide particles, 300 or more primary particles of inorganic oxide particles are identified in one field of view. The SEM observation is conducted with an accelerating voltage of 15 kV, an emission current of 20 μA, and a WD of 15 mm. The EDX analysis is conducted under the same conditions as above for a detection time of 60 minutes.

(4) The resulting image is captured into an image processor "LUZEXIII" produced by NIRECO CORPORATION. The area of each particle is measured by image analysis.

(5) The size of each inorganic oxide particle is calculated on the basis of the area calculated above in terms of equivalent circle diameter.

(6) 100 inorganic oxide particles having an equivalent circle diameter of less than 80 nm are selected. For the selected inorganic oxide particles, a cumulative distribution curve is drawn in ascending order in terms of equivalent circle diameter. The particle size at which the cumulative number reaches 50% is considered the number average particle size of the inorganic oxide particles.

The surfaces of the inorganic oxide particles used as an external additive may be subjected to a hydrophobic treatment. The hydrophobic treatment is performed by, for example, immersing the inorganic oxide particles in a hydrophobizing agent. Examples of the hydrophobizing agent include, but are not limited to, a silane coupling agent, a silicone oil, a titanate coupling agent, and aluminum coupling agent. These hydrophobizing agents may be used alone or in combination of two or more.

The amount of the hydrophobizing agent is commonly, for example, 1 part by mass or more and 10 parts by mass or less relative to 100 parts by mass of the inorganic oxide particles.

Examples of the external additive particles include particles of a resin, such as polystyrene, polymethyl methacrylate (PMMA), or a melamine resin; and particles of a cleaning lubricant, such as a fluorine-contained resin.

The amount of the other external additive used is preferably, for example, 0.01% by mass or more and 5% by mass or less and is more preferably 0.01% by mass or more and 2.0% by mass or less of the amount of the toner particles.

Method for Producing Toner

The toner according to the exemplary embodiment is produced by, after the preparation of the toner particles, depositing an external additive on the surfaces of the toner particles.

The toner particles may be prepared by any dry process, such as knead pulverization, or any wet process, such as aggregation coalescence, suspension polymerization, or dissolution suspension. However, a method for preparing the toner particles is not limited thereto, and any suitable method known in the related art may be used. Among these methods, aggregation coalescence may be used in order to prepare the toner particles.

Specifically, in the case where, for example, aggregation coalescence is used in order to prepare the toner particles, the toner particles are prepared by the following steps:

preparing a resin particle dispersion liquid in which resin particles serving as a binder resin are dispersed (i.e., resin particle dispersion liquid preparation step);

causing the resin particles (and, as needed, other particles) to aggregate together in the resin particle dispersion liquid (or in the resin particle dispersion liquid mixed with another particle dispersion liquid as needed) in order to form aggregated particles (i.e., aggregated particle forming step);

and heating the resulting aggregated particle dispersion liquid in which the aggregated particles are dispersed in order to cause fusion and coalescence of the aggregated particles to occur and thereby form toner particles (fusion-coalescence step).

Each of the above steps is described below in detail.

Hereinafter, a method for preparing toner particles including a colorant and a release agent is described. However, it should be noted that the colorant and the release agent are optional. It is needless to say that additives other than a colorant and a release agent may be used.

Resin Particle Dispersion Liquid Preparation Step

In addition to a resin particle dispersion liquid in which resin particles serving as a binder resin is dispersed, for example, a colorant particle dispersion liquid in which colorant particles are dispersed and a release agent particle dispersion liquid in which release agent particles are dispersed are prepared.

The resin particle dispersion liquid is prepared by, for example, dispersing resin particles in a dispersion medium using a surfactant.

Examples of the dispersion medium used for preparing the resin particle dispersion liquid include aqueous media.

Examples of the aqueous media include water, such as distilled water and ion-exchange water; and alcohols. These aqueous media may be used alone or in combination of two or more.

Examples of the surfactant include anionic surfactants, such as sulfate surfactants, sulfonate surfactants, and phosphate surfactants; cationic surfactants, such as amine salt surfactants and quaternary ammonium salt surfactants; and nonionic surfactants, such as polyethylene-glycol surfactants, alkylphenol-ethylene-oxide-adducts surfactants, and polyhydric-alcohol surfactants. Among these surfactants, in particular, the anionic surfactants and the cationic surfactants may be used. The nonionic surfactants may be used in combination with the anionic surfactants and the cationic surfactants.

These surfactants may be used alone or in combination of two or more.

In the preparation of the resin particle dispersion liquid, the resin particles can be dispersed in a dispersion medium by any suitable dispersion method commonly used in the related art in which, for example, a rotary shearing homogenizer, a ball mill, a sand mill, or a dyno mill that includes media is used. Depending on the type of the resin particles used, the resin particles may be dispersed in the dispersion medium by, for example, phase inversion emulsification. Phase inversion emulsification is a method in which the resin to be dispersed is dissolved in a hydrophobic organic solvent in which the resin is soluble, a base is added to the resulting organic continuous phase (i.e., O phase) to perform neutralization, and subsequently an aqueous medium (i.e., W phase) is charged in order to perform phase inversion from W/O to O/W and disperse the resin in the aqueous medium in the form of particles.

The volume average diameter of the resin particles dispersed in the resin particle dispersion liquid is preferably, for example, 0.01 μm or more and 1 μm or less, is more preferably 0.08 μm or more and 0.8 μm or less, and is further preferably 0.1 μm or more and 0.6 μm or less.

The volume average diameter of the resin particles is determined in the following manner. The particle diameter distribution of the resin particles is obtained using a laser diffraction particle-size-distribution measurement apparatus (e.g., "LA-700" produced by HORIBA, Ltd.). The particle diameter distribution measured is divided into a number of particle diameter ranges (i.e., channels). For each range, in ascending order in terms of particle diameter, the cumulative volume is calculated and plotted to draw a cumulative distribution curve. A particle diameter at which the cumulative volume reaches 50% is considered to be the volume particle diameter D50v. The volume average diameters of particles included in the other dispersion liquids are also determined in the above-described manner.

The content of the resin particles included in the resin particle dispersion liquid is preferably 5% by mass or more and 50% by mass or less and is more preferably 10% by mass or more and 40% by mass or less.

The colorant particle dispersion liquid, the release agent particle dispersion liquid, and the like are also prepared as in the preparation of the resin particle dispersion liquid. In other words, the above-described specifications for the volume average diameter of the particles included in the resin particle dispersion liquid, the dispersion medium of the resin particle dispersion liquid, the dispersion method used for preparing the resin particle dispersion liquid, and the content of the particles in the resin particle dispersion liquid can also be applied to colorant particles dispersed in the colorant particle dispersion liquid and release agent particles dispersed in the release agent particle dispersion liquid.

Aggregated Particle Forming Step

The resin particle dispersion liquid is mixed with the colorant particle dispersion liquid and the release agent particle dispersion liquid.

In the resulting mixed dispersion liquid, heteroaggregation of the resin particles with the colorant particles and the release agent particles is performed in order to form aggregated particles including the resin particles, the colorant particles, and the release agent particles, the aggregated particles having a diameter close to that of the desired toner particles.

Specifically, for example, a flocculant is added to the mixed dispersion liquid, and the pH of the mixed dispersion liquid is controlled to be acidic (e.g., pH of 2 or more and 5 or less). A dispersion stabilizer may be added to the mixed dispersion liquid as needed. Subsequently, the mixed dispersion liquid is heated to a temperature close to the glass transition temperature of the resin particles (specifically, e.g., [glass transition temperature of the resin particles—30° C.] or more and [the glass transition temperature—10° C.] or less), and thereby the particles dispersed in the mixed dispersion liquid are caused to aggregate together to form aggregated particles.

In the aggregated particle forming step, alternatively, for example, the above flocculant may be added to the mixed dispersion liquid at room temperature (e.g., 25° C.) while the mixed dispersion liquid is stirred using a rotary-shearing homogenizer. Then, the pH of the mixed dispersion liquid is controlled to be acidic (e.g., pH of 2 or more and 5 or less), and a dispersion stabilizer may be added to the mixed dispersion liquid as needed. Subsequently, the mixed dispersion liquid is heated in the above-described manner.

Examples of the flocculant include surfactants, inorganic metal salts, and divalent or higher metal complexes that have a polarity opposite to that of the surfactant included in the mixed dispersion liquid. Using a metal complex as a flocculant reduces the amount of surfactant used and, as a result, charging characteristics may be enhanced.

An additive capable of forming a complex or a bond similar to a complex with the metal ions contained in the flocculant may optionally be used in combination with the flocculant. An example of the additive is a chelating agent.

Examples of the inorganic metal salts include metal salts, such as calcium chloride, calcium nitrate, barium chloride, magnesium chloride, zinc chloride, aluminum chloride, and aluminum sulfate; and inorganic metal salt polymers, such as polyaluminum chloride, polyaluminum hydroxide, and calcium polysulfide.

The chelating agent may be a water-soluble chelating agent. Examples of such a chelating agent include oxycarboxylic acids, such as tartaric acid, citric acid, and gluconic acid; and aminocarboxylic acids, such as iminodiacetic acid (IDA), nitrilotriacetic acid (NTA), and ethylenediaminetetraacetic acid (EDTA).

The amount of the chelating agent used is preferably 0.01 parts by mass or more and 5.0 parts by mass or less and is more preferably 0.1 parts by mass or more and less than 3.0 parts by mass relative to 100 parts by mass of the resin particles.

Fusion-Coalescence Step

The aggregated particle dispersion liquid in which the aggregated particles are dispersed is heated to, for example, the glass transition temperature of the resin particles or more (e.g., temperature higher than the glass transition temperature of the resin particles by 10° C. to 30° C.) in order to perform fusion and coalescence of the aggregated particles. Hereby, toner particles are prepared.

The toner particles are prepared through the above-described steps.

It is also possible to prepare the toner particles by, after preparing the aggregated particle dispersion liquid in which the aggregated particles are dispersed, further mixing the aggregated particle dispersion liquid with a resin particle dispersion liquid in which resin particles are dispersed and subsequently performing aggregation such that the resin particles are deposited on the surfaces of the aggregated particles in order to form second aggregated particles; and by heating the resulting second aggregated particle dispersion liquid in which the second aggregated particles are dispersed and thereby causing fusion and coalescence of the second aggregated particles to occur in order to form toner particles having a core-shell structure.

After the completion of the fusion-coalescence step, the toner particles formed in the solution are subjected to any suitable cleaning step, solid-liquid separation step, and drying step that are known in the related art in order to obtain dried toner particles. In the cleaning step, the toner particles may be subjected to displacement washing using ion-exchange water to a sufficient degree from the viewpoint of electrification characteristics. Examples of a solid-liquid separation method used in the solid-liquid separation step include suction filtration and pressure filtration from the viewpoint of productivity. Examples of a drying method used in the drying step include freeze-drying, flash drying, fluidized drying, and vibrating fluidized drying from the viewpoint of productivity.

The toner according to the exemplary embodiment is produced by, for example, adding an external additive to the dried toner particles and mixing the resulting toner particles using a V-blender, a HENSCHEL mixer, a Lodige mixer, or the like. Optionally, coarse toner particles may be removed using a vibrating screen classifier, a wind screen classifier, or the like.

Electrostatic Image Developer

The replenishment toner included in the replenishment toner container included in the image forming apparatus according to the exemplary embodiment is supplied to the developing unit and used for forming images as an electrostatic image developer. The electrostatic image developer includes at least the replenishment toner. The electrostatic image developer may be a single component developer including only the replenishment toner or may be a two-component developer that is a mixture of the replenishment toner and a carrier.

The type of the carrier is not limited, and any suitable carrier known in the related art may be used. Examples of the carrier include a coated carrier prepared by coating the surfaces of cores including magnetic powder particles with a resin; a magnetic-powder-dispersed carrier prepared by dispersing and mixing magnetic powder particles in a matrix resin; and a resin impregnated carrier prepared by impregnating a porous magnetic powder with a resin. The magnetic-powder-dispersed carrier and the resin impregnated carrier may also be prepared by coating the surfaces of particles constituting the carrier, that is, core particles, with a resin.

Examples of the magnetic powder include powders of magnetic metals, such as iron, nickel, and cobalt; and powders of magnetic oxides, such as ferrite and magnetite.

Examples of the coat resin and the matrix resin include polyethylene, polypropylene, polystyrene, poly(vinyl acetate), poly(vinyl alcohol), poly(vinyl butyral), poly(vinyl chloride), poly(vinyl ether), poly(vinyl ketone), a vinyl chloride-vinyl acetate copolymer, a styrene-acrylic acid ester copolymer, a straight silicone resin including an organosiloxane bond and the modified products thereof, a fluorine resin, polyester, polycarbonate, a phenolic resin, and an epoxy resin. The coat resin and the matrix resin may optionally include additives, such as conductive particles. Examples of the conductive particles include particles of metals, such as gold, silver, and copper; and particles of carbon black, titanium oxide, zinc oxide, tin oxide, barium sulfate, aluminum borate, and potassium titanate.

The surfaces of the cores can be coated with a resin by, for example, using a coating layer forming solution prepared by dissolving the coat resin and, as needed, various types of additives in a suitable solvent. The type of the solvent is not limited and may be selected with consideration of the type of the resin used, ease of applying the coating layer forming solution, and the like.

Specific examples of a method for coating the surfaces of the cores with the coat resin include an immersion method in which the cores are immersed in the coating layer forming solution; a spray method in which the coating layer forming solution is sprayed onto the surfaces of the cores; a fluidized bed method in which the coating layer forming solution is sprayed onto the surfaces of the cores while the cores are floated using flowing air; and a kneader coater method in which the cores of the carrier are mixed with the coating layer forming solution in a kneader coater and subsequently the solvent is removed.

The mixing ratio (i.e., mass ratio) of the toner to the carrier in the two-component developer is preferably toner: carrier=1:100 to 30:100 and is more preferably 3:100 to 20:100.

EXAMPLES

Details of the exemplary embodiment of the present disclosure are described below with reference to Examples below. The exemplary embodiment of the present disclosure is not limited to Examples below. Hereinafter, the terms "part" and "%" are on a mass basis unless otherwise specified.

Preparation of Silica Particles

Preparation of Silica Particle Dispersion Liquid (1)

To a glass reaction container equipped with a stirrer, a dropping nozzle, and a thermometer, 300 parts of methanol and 70 parts of 10% ammonia water are added. The resulting mixture is stirred to form an alkali catalyst solution. After the temperature of the alkali catalyst solution has been adjusted to be 30° C., 185 parts of tetramethoxysilane and 50 parts of 8% ammonia water are simultaneously added dropwise to the alkali catalyst solution while stirring is performed. Hereby, a hydrophilic silica particle dispersion liquid (solid content: 12%) is prepared. The amount of time during which tetramethoxysilane and ammonia water are added dropwise to the alkali catalyst solution (hereinafter, referred to as "addition time") is 30 minutes. The silica particle dispersion liquid is concentrated to have a solid content of 40% with a rotary filter "R-Fine" produced by Kotobuki Industries Co., Ltd. This concentrated dispersion liquid is used as a silica particle dispersion liquid (1).

Preparation of Silica Particle Dispersion Liquids (2) to (8) and (c1) to (c6)

Silica particle dispersion liquids (2) to (8) and (c1) to (c6) are prepared as in the preparation of the silica particle dispersion liquid (1), except that the content of the ammonia water in the alkali catalyst solution and the following conditions under which the silica particles are formed are changed as described in Table 1: the total amount of tetramethoxysilane added, the total amount of the ammonia water added, the addition time, and the temperature at which the addition of tetramethoxysilane and ammonia water is started (hereinafter, referred to as "addition start temperature").

Preparation of Silica Particles (S1)

Using the silica particle dispersion liquid (1), the surfaces of silica particles are treated with a siloxane compound in a supercritical carbon dioxide atmosphere in the following manner. The surface treatment is performed using an apparatus equipped with a carbon dioxide cylinder, a carbon dioxide pump, an entrainer pump, an autoclave with a stirrer (capacity: 500 ml), and a pressure valve.

First, 300 parts of the silica particle dispersion liquid (1) is charged into the autoclave with a stirrer (capacity: 500 ml), and the stirrer is rotated at 100 rpm. Subsequently, liquid carbon dioxide is injected into the autoclave. While the temperature is increased with a heater, the pressure is increased with the carbon dioxide pump to bring the inside of the autoclave into a supercritical state of 150° C. and 15 MPa. Subsequently, while the pressure inside the autoclave is maintained to be 15 MPa with the pressure valve, supercritical carbon dioxide is passed through the autoclave with the carbon dioxide pump in order to remove methanol and water from the silica particle dispersion liquid (1) (solvent removal step). Hereby, silica particles (i.e., untreated silica particles) are prepared.

The flow of supercritical carbon dioxide is stopped when the amount of the supercritical carbon dioxide passed (cumulative amount; in terms of the amount of carbon dioxide in the standard condition) reaches 900 parts.

Then, while the temperature is maintained to be 150° C. with a heater and the pressure is maintained to be 15 MPa with the carbon dioxide pump in order to maintain the supercritical state of carbon dioxide inside the autoclave, a treatment agent solution prepared by dissolving 0.3 parts of a dimethyl silicone oil (DSO) "KF-96" produced by Shin-Etsu Chemical Co., Ltd. having a viscosity of 10,000 cSt, which is a siloxane compound, in 20 parts of hexamethyldisilazane (HMDS) produced by Yuki Gosei Kogyo Co., Ltd., which is a hydrophobizing agent, relative to 100 parts of the silica particles (i.e., untreated silica particles) is injected into the autoclave with the entrainer pump. While the resulting mixture is stirred, the mixture is caused to react at 180° C. for 20 minutes. Subsequently, supercritical carbon dioxide is again passed through the autocrave to remove excess treatment agent solution. Subsequently, the stirring is stopped. The pressure valve is opened to reduce the pressure inside the autoclave to atmospheric pressure. The temperature is reduced to room temperature (25° C.).

In the above-described manner, the solvent removal step and the surface treatment using HMDS and DSO are performed to prepare silica particles (S1) surface-treated with a hydrophobizing agent.

Preparation of Silica Particles (S2) to (S8) and (cS1) to (cS6)

Silica particles (S2) to (S8) and (cS1) to (cS6) surface-treated with a hydrophobizing agent are prepared as in the preparation of the silica particles (S1).

Preparation of Silica Particles (cS7) and (cS8)

Hydrophobic silica particles (cS7) are prepared as described in Paragraphs [0051] to [0053] of Japanese Laid Open Patent Application Publication No. 2008-174430. Hydrophobic silica particles (cS8) are prepared as described in Paragraph [0019] of Japanese Laid Open Patent Application Publication No. 2001-194824.

TABLE 1

| | | | | | Total | Silica particle forming conditions | | | |
|---|---|---|---|---|---|---|---|---|---|
| | | | | | amount | Ammonia water | | | |
| | Silica | Alkali catalyst solution | | | of | | Total | | Addition |
| | particle | | Ammonia water | | TMOS | | amount | Addition | start |
| Silica particles | dispersion liquid | Methanol (part) | Concentration (%) | Amount (part) | added (part) | Concentration (%) | added (part) | time (minute) | temperature (°C.) |
| S1 | (1) | 300 | 10 | 70 | 185 | 8 | 50 | 30 | 30 |
| S2 | (2) | 300 | 10 | 70 | 185 | 8 | 50 | 30 | 35 |
| S3 | (3) | 300 | 10 | 70 | 185 | 8 | 45 | 30 | 30 |
| S4 | (4) | 300 | 10 | 75 | 185 | 8 | 50 | 30 | 30 |
| S5 | (5) | 300 | 10 | 65 | 185 | 8 | 50 | 50 | 30 |
| S6 | (6) | 300 | 10 | 65 | 170 | 8 | 50 | 20 | 30 |

TABLE 1-continued

| Silica particles | Silica particle dispersion liquid | Alkali catalyst solution: Methanol (part) | Alkali catalyst solution: Ammonia water Concentration (%) | Alkali catalyst solution: Ammonia water Amount (part) | Total amount of TMOS added (part) | Silica particle forming conditions: Ammonia water Concentration (%) | Silica particle forming conditions: Total amount added (part) | Silica particle forming conditions: Addition time (minute) | Silica particle forming conditions: Addition start temperature (°C.) |
|---|---|---|---|---|---|---|---|---|---|
| S7 | (7) | 300 | 10 | 70 | 247 | 8 | 67 | 55 | 40 |
| S8 | (8) | 300 | 10 | 70 | 123 | 8 | 30 | 18 | 30 |
| cS1 | (c1) | 300 | 10 | 70 | 185 | 8 | 50 | 30 | 45 |
| cS2 | (c2) | 300 | 10 | 50 | 185 | 8 | 50 | 30 | 20 |
| cS3 | (c3) | 300 | 10 | 110 | 185 | 8 | 50 | 30 | 30 |
| cS4 | (c4) | 300 | 10 | 46 | 120 | 8 | 30 | 30 | 30 |
| cS5 | (c5) | 300 | 10 | 70 | 340 | 8 | 92 | 55 | 30 |
| cS6 | (c6) | 300 | 10 | 70 | 120 | 8 | 30 | 20 | 30 |

Preparation of Particle Dispersion Liquids

Preparation of Amorphous Polyester Resin Particle Dispersion Liquid (A1)

Terephthalic acid: 70 parts

Fumaric acid: 30 parts

Ethylene glycol: 45 parts 1,5-Pentanediol: 46 parts

Into a flask equipped with a stirring device, a nitrogen introducing tube, a temperature sensor, and a fractionating column, the above materials are charged. Under a nitrogen stream, the temperature is increased to 220° C. over 1 hour, and 1 part of titanium tetraethoxide relative to 100 parts of the total amount of the above materials is added to the flask. While the product water is removed by distillation, the temperature is increased to 240° C. over 0.5 hours and dehydration condensation is continued for 1 hour at 240° C. Subsequently, the product of the reaction is cooled. Hereby, a polyester resin having a weight average molecular weight of 9,500 and a glass transition temperature of 62° C. is synthesized.

Into a container equipped with a temperature control unit and a nitrogen purging unit, 40 parts of ethyl acetate and 25 parts of 2-butanol are charged to form a mixed solvent. To the mixed solvent, 100 parts of a polyester resin is gradually added and dissolved in the mixed solvent. To the resulting solution, a 10% aqueous ammonia solution is added in an amount 3 times by mole with respect to the acid value of the resin. The resulting mixture is stirred for 30 minutes. Then, the inside of the container is purged with dry nitrogen. While the temperature is maintained to be 40° C. and the liquid mixture is stirred, 400 parts of ion-exchange water is added dropwise to the container at a rate of 2 part/min in order to perform emulsification. After the addition of ion-exchange water has been terminated, the resulting emulsion is cooled to 25° C. Hereby, a resin particle dispersion liquid that includes resin particles having a volume average particle size of 200 nm dispersed therein is prepared. Ion-exchange water is added to the resin particle dispersion liquid to adjust the solid content in the dispersion liquid to be 20%. Hereby, an amorphous polyester resin particle dispersion liquid (A1) is prepared.

Preparation of Crystalline Polyester Resin Particle Dispersion Liquid (C1)

1,10-Decanedicarboxylic acid: 98 parts

Sodium dimethyl-5-sulfonate isophthalate: 24 parts 1,9-Nonanediol: 100 parts

Dibutyltin oxide (catalyst): 0.3 parts

The above components are charged into a three-necked flask dried by heating. Subsequently, the pressure is reduced to replace the atmosphere inside the container with an inert atmosphere with a nitrogen gas. The resulting mixture is stirred by mechanical stirring and caused to reflux at 180° C. for 5 hours. Then, the temperature is gradually increased to 230° C. under reduced pressure and stirring is performed for 2 hours. When the mixture becomes viscous, air cooling is performed and the reaction is stopped. Hereby, a crystalline polyester resin is prepared. The weight average molecular weight (Mw) of the crystalline polyester resin measured in terms of polystyrene is 9,700. The crystalline polyester resin has a melting temperature of 78° C.

Then, 90 parts of the crystalline polyester resin, 1.8 parts of an anionic surfactant "NEOGEN RK" produced by DKS Co. Ltd., and 210 parts of ion-exchange water are heated to 100° C. and dispersed with ULTRA-TURRAX T50 produced by IKA. Subsequently, a dispersion treatment is performed for 1 hour using a pressure-discharge Gaulin homogenizer. Hereby, a crystalline polyester resin particle dispersion liquid (C1) having a volume average particle size of 200 nm and a solid content of 20% is prepared.

Preparation of Release Agent Particle Dispersion Liquid

Paraffin wax "HNP-9" produced by Nippon Seiro Co., Ltd.: 100 parts

Anionic surfactant "NEOGEN RK" produced by Dai-ichi Kogyo Seiyaku Co., Ltd.: 1 part Ion-exchange water: 350 parts The above materials are mixed with one another and heated to 100° C. The resulting mixture is dispersed with a homogenizer "ULTRA-TURRAX T50" produced by IKA and then further dispersed with a Manton Gaulin high-pressure homogenizer produced by Gaulin. Hereby, a release agent particle dispersion liquid (solid content: 20%) in which release agent particles having a volume average particle size of 200 nm are dispersed is prepared.

Preparation of Black Colored Particle Dispersion Liquid

Carbon black "REGAL330" produced by Cabot Corporation: 50 parts

Anionic surfactant "NEOGEN RK" produced by DKS Co. Ltd.: 5 parts

Ion-exchange water: 192.9 parts

The above components are mixed with one another, and the resulting mixture is subjected to ULTIMIZER produced by Sugino Machine Limited at 240 MPa for 10 minutes. Hereby, a black colored particle dispersion liquid (solid content: 20%) is prepared.

Preparation of Toner Particles

Preparation of Toner Particles (A1)

Ion-exchange water: 200 parts Amorphous polyester resin particle dispersion liquid (A1): 150 parts Crystalline polyester resin particle dispersion liquid (C1): 10 parts Black colored particle dispersion liquid: 15 parts Release agent particle dispersion liquid: 10 parts Anionic surfactant (TAYCAPOWER): 2.8 parts The above materials are charged into a round-bottom flask made of stainless steel. After pH has been adjusted to be 3.5 by addition of 0.1 N nitric acid, an aqueous polyaluminum chloride (PAC) solution prepared by dissolving 2.0 parts of PAC (30% powder produced by Oji Paper Co., Ltd.) in 30 parts of ion-exchange water is added to the flask. After dispersion has been performed with a homogenizer "ULTRA-TURRAX T50" produced by IKA at 30° C., the temperature is increased to 45° C. in a heating oil bath. Then, holding is performed until the volume average particle size reaches 4.8 μm. Subsequently, 60 parts of the amorphous polyester resin particle dispersion liquid (A1) is added to the flask and holding is performed for 30 minutes. When the volume average particle size reaches 5.2 μm, another 60 parts of the amorphous polyester resin particle dispersion liquid (A1) is added to the flask and holding is performed for 30 minutes. Then, 20 parts of a 10% aqueous solution of nitrilotriacetic acid (NTA) metal salt "CHELEST 70" produced by Chelest Corporation is added to the flask. Subsequently, the pH is adjusted to be 9.0 using a 1 N aqueous sodium hydroxide solution. Then, 1.0 parts of an anion activator "TAYCAPOWER" is added to the flask. While stirring is continued, the temperature is increased to 85° C. and then holding is performed for 5 hours. Subsequently, the temperature is reduced to 20° C. at a rate of 20° C./min. Then, filtration is performed. The resulting substance is sufficiently washed with ion-exchange water and dried to form toner particles (A1) having a volume average particle size of 6.0 μm.

Preparation of Toners

Preparation of Toner (A1)

With 100 parts of the toner particles (A1), 1.5 parts of the silica particles (S1) and 0.5 parts of titania particles having a number average particle size of 20 nm, which are inorganic oxide particles, are mixed. The resulting mixture is stirred with a sample mill at a rotation speed of 13,000 rpm for 30 seconds. Then, screening is performed with a vibration sieve having an opening of 45 μm. Hereby, a toner (A1) is prepared.

Preparation of Toners (A2) to (A8) and (cA1) to (cA8)

Toners (A2) to (A8) and (cA1) to (cA8) are prepared as in the preparation of toner (A1), except that the type of the silica particles used is changed as described in Table 2.

Preparation of Developers

Preparation of Developers (A1) to (A8) and (cA1) to (cA8)

Into a V-blender, 10 parts of a specific one of the toners and 100 parts of the resin-coated carrier particles described below are charged. The resulting mixture is stirred for 20 minutes and then screened through a vibration sieve having an opening of 212 μm to form a developer.

Mn—Mg—Sr ferrite particles (average particle size: 40 μm): 100 parts

Toluene: 14 parts

Polymethyl methacrylate: 2 parts

Carbon black "VXC72" produced by Cabot Corporation: 0.12 parts

The above materials except the ferrite particles are mixed with glass beads (diameter 1 mm, in an amount equal to that of the toluene used). The resulting mixture is stirred with a sand mill produced by Kansai Paint Co., Ltd. at a rotation speed of 1,200 rpm for 30 minutes to form a dispersion liquid. The dispersion liquid and the ferrite particles are charged into a vacuum degassing kneader. While the resulting mixture is stirred, the pressure is reduced and drying is performed. Hereby, resin-coated carrier particles are prepared.

Performance Evaluations

A rotary toner bottle having the shape illustrated in FIG. 3 is prepared. The bottle main body of the rotary toner bottle has a diameter of 110 mm and a volume of 4,012 $cm^3$. A single-helical protrusion is formed in the inner surface of the bottle main body. The protrusion has an average width of 3.5 mm, an average height of 4.5 mm, and an average helical pitch of 80 mm. A specific one of the toners prepared in Examples above is charged into the rotary toner bottle. The rotary toner bottle is attached to a modification of an image forming apparatus "D136" produced by Fuji Xerox Co., Ltd. That is, a specific one of the developers prepared in Examples is charged into the developing unit of the image forming apparatus.

Occurrence of Fog in Low Temperature, Low Humidity Environment

The image forming apparatus is left to stand at 10° C. and a relative humidity of 10% for 24 hours for performing temperature and moisture conditioning. Subsequently, an image is formed continuously on 100,000 A4 size paper sheets. The image consists of an image having a size of 20 cm×25 cm with an image density of 100% which is formed in the upper part of each paper in the portrait direction and Roman letters A to Z formed below the 20 cm×25 cm image in MS Gothic/14 point/half-width. The conditions of the letters formed on the 100,000th sheet are visually inspected and classified as follows.

A: Toner fog is not confirmed around the letters.

B: Although slight toner fog is visually confirmed around the letters, it is negligible and does not interfere with the use of the image forming apparatus.

C: Toner fog is visually confirmed around the letters and interferes with the use of the image forming apparatus.

Reduction in Image Density in High Temperature, High Humidity Environment

The image forming apparatus is left to stand at 30° C. and a relative humidity of 85% for 24 hours for performing temperature and moisture conditioning. Subsequently, an image is formed continuously on 100,000 A4 size paper sheets. The image is a halftone image having an area ratio of 90% and an image density of 30%. The conditions of the halftone image formed on the 100,000th sheet are visually inspected and classified as follows.

A: The entirety of the image has a sufficient image density, and inconsistency in the image density is not confirmed.

B: Although some parts of the image have a low image density, the inconsistency in the image density is negligible and does not interfere with the use of the image forming apparatus.

C: The entirety of the image has a low image density, or inconsistency in the image density is not acceptable.

TABLE 2

| | Toner and developer | Toner particles | Silica particles | | | |
|---|---|---|---|---|---|---|
| | | | Type | Average circularity | Number average particle size (nm) | Upper GSDp |
| Comparative example 1 | cA1 | A1 | cS1 | 0.958 | 120 | 1.090 |
| Comparative example 2 | cA2 | A1 | cS2 | 0.945 | 120 | 1.071 |
| Comparative example 3 | cA3 | A1 | cS3 | 0.981 | 120 | 1.022 |
| Comparative example 4 | cA4 | A1 | cS4 | 0.928 | 120 | 1.068 |
| Comparative example 5 | cA5 | A1 | cS5 | 0.958 | 140 | 1.029 |
| Comparative example 6 | cA6 | A1 | cS6 | 0.958 | 100 | 1.059 |
| Comparative example 7 | cA7 | A1 | cS7 | 0.950 | 120 | 1.072 |
| Comparative example 8 | cA8 | A1 | cS8 | 0.942 | 115 | 1.093 |
| Example 1 | A1 | A1 | S1 | 0.958 | 120 | 1.058 |
| Example 2 | A2 | A1 | S2 | 0.958 | 120 | 1.077 |
| Example 3 | A3 | A1 | S3 | 0.958 | 120 | 1.065 |
| Example 4 | A4 | A1 | S4 | 0.974 | 120 | 1.025 |
| Example 5 | A5 | A1 | S5 | 0.941 | 120 | 1.032 |
| Example 6 | A6 | A1 | S6 | 0.958 | 120 | 1.046 |
| Example 7 | A7 | A1 | S7 | 0.964 | 128 | 1.068 |
| Example 8 | A8 | A1 | S8 | 0.950 | 112 | 1.061 |

| | Silica particles | | | Evaluations | |
|---|---|---|---|---|---|
| | Lower GSDp | Proportion of silica particles having circularity of 0.92 or more (number%) | Degree of hydrophobicity (%) | Low temperature low humidity: occurrence of fog | High temperature high humidity: reduction in image density |
| Comparative example 1 | 1.041 | 85 | 64 | A | C |
| Comparative example 2 | 1.074 | 72 | 64 | C | B |
| Comparative example 3 | 1.028 | 95 | 64 | C | C |
| Comparative example 4 | 1.055 | 89 | 64 | C | C |
| Comparative example 5 | 1.033 | 94 | 64 | A | C |
| Comparative example 6 | 1.055 | 88 | 64 | C | A |
| Comparative example 7 | 1.049 | 72 | 64 | C | A |
| Comparative example 8 | 1.037 | 82 | 58 | C | B |
| Example 1 | 1.042 | 90 | 64 | A | A |
| Example 2 | 1.071 | 87 | 64 | A | B |
| Example 3 | 1.081 | 88 | 64 | B | A |
| Example 4 | 1.028 | 94 | 64 | A | B |
| Example 5 | 1.066 | 90 | 64 | B | A |
| Example 6 | 1.039 | 84 | 64 | B | A |
| Example 7 | 1.060 | 98 | 64 | B | B |
| Example 8 | 1.074 | 89 | 64 | B | B |

The foregoing description of the exemplary embodiment of the present disclosure has been provided for the purposes of illustration and description. It is not intended to be exhaustive or to limit the disclosure to the precise forms disclosed. Obviously, many modifications and variations will be apparent to practitioners skilled in the art. The embodiment was chosen and described in order to best explain the principles of the disclosure and its practical applications, thereby enabling others skilled in the art to understand the disclosure for various embodiments and with the various modifications as are suited to the particular use contemplated. It is intended that the scope of the disclosure be defined by the following claims and their equivalents.

What is claimed is:

1. An image forming apparatus comprising:

an image holding member;

a charging unit configured to charge a surface of the image holding member;

an electrostatic image forming unit configured to form an electrostatic image on the charged surface of the image holding member;

a developing unit that includes an electrostatic image developer, wherein the developing unit is configured to develop the electrostatic image formed on the surface of the image holding member with the electrostatic image developer to form a toner image;

a transfer unit configured to transfer the toner image onto a surface of a recording medium;

a fixing unit configured to fix the transferred toner image on the surface of the recording medium;

a replenishment toner container that includes a replenishment toner that is to be supplied into the developing unit, wherein the replenishment toner container is configured to discharge the replenishment toner by rotation of the replenishment toner container;

a replenishment toner container mounting unit configured to hold the replenishment toner container, wherein the replenishment toner container mounting unit is configured to rotate the replenishment toner container; and a toner supply pass that connects the replenishment toner container mounting unit to the developing unit, wherein the toner supply pass is configured to supply the replenishment toner into the developing unit, wherein the replenishment toner comprises:

toner particles; and silica particles having a number average particle size of 110 nm to 130 nm, a large-diameter-side number particle size distribution index (upper GSDp) of less than 1.080, and an average circularity of 0.94 to 0.98, wherein 80 number % or more of the silica particles have a circularity of 0.92 or more, wherein the replenishment toner container includes:

a toner discharge port formed in an end face of the replenishment toner container in a direction of a longer axis of the replenishment toner container;

a toner accommodating portion; and a continuous protrusion formed in an inner surface of the toner accommodating portion so as to extend toward the toner discharge port in a helical pattern, and wherein the protrusion has an average width of 2 mm to 10 mm, an average height of 2 mm to 10 mm, and an average helical pitch of 20 mm to 100 mm.

2. The image forming apparatus according to claim 1, wherein the silica particles have a large-diameter-side number particle size distribution index (upper GSDp) of 1.075 or less.

3. The image forming apparatus according to claim 1, wherein the silica particles have a small-diameter-side number particle size distribution index (lower GSDp) of 1.080 or less.

4. The image forming apparatus according to claim 1, wherein the silica particles have an average circularity of 0.95 to 0.97.

5. The image forming apparatus according to claim 1, wherein 85 number % or more of the silica particles have a circularity of 0.92 or more.

6. The image forming apparatus according to claim 1, wherein the replenishment toner includes inorganic oxide particles having a number average particle size of 5 nm to 50 nm.

7. The image forming apparatus according to claim 1, wherein the toner particles include a styrene acrylic resin as a binder resin.

8. The image forming apparatus according to claim 1, wherein the toner particles include an amorphous polyester resin as a binder resin.

9. The image forming apparatus according to claim 1, wherein the replenishment toner container includes polyethylene terephthalate or a polyolefin.

10. The image forming apparatus according to claim 1, wherein the replenishment toner container mounting unit is configured to rotate the replenishment toner container about a longer axis of the replenishment toner container.

11. The image forming apparatus according to claim 1, wherein the replenishment toner container mounting unit is configured to hold the replenishment toner container such that a longer axis of the replenishment toner container extends in a horizontal direction.

12. An image forming apparatus comprising:

an image holding member;

a charging unit configured to charge a surface of the image holding member;

an electrostatic image forming unit configured to form an electrostatic image on the charged surface of the image holding member;

a developing unit that includes an electrostatic image developer, wherein the developing unit is configured to develop the electrostatic image formed on the surface of the image holding member with the electrostatic image developer to form a toner image;

a transfer unit configured to transfer the toner image onto a surface of a recording medium;

a fixing unit configured to fix the transferred toner image on the surface of the recording medium;

a replenishment toner container that includes a replenishment toner that is to be supplied into the developing unit, wherein the replenishment toner container is configured to discharge the replenishment toner by rotation of the replenishment toner container;

a replenishment toner container mounting unit configured to hold the replenishment toner container, wherein the replenishment toner container mounting unit is configured to rotate the replenishment toner container; and a toner supply pass that connects the replenishment toner container mounting unit to the developing unit, wherein the toner supply pass is configured to supply the replenishment toner into the developing unit, wherein the replenishment toner comprises:

toner particles; and silica particles having a number average particle size of 110 nm to 130 nm, a large-diameter-side number particle size distribution index (upper GSDp) of less than 1.080, and an average circularity of 0.94 to 0.98, wherein 80 number % or more of the silica particles have a circularity of 0.92 or more, wherein the replenishment toner container includes:

a toner discharge port formed in an end face of the replenishment toner container in a direction of a longer axis of the replenishment toner container;

a toner accommodating portion; and a continuous protrusion formed in an inner surface of the toner accommodating portion so as to extend toward the toner discharge port in a helical pattern, and wherein the protrusion has an average width 150 to 2,500 times a volume average particle size of the toner and an average height 150 to 2,500 times the volume average particle size of the toner.

13. A toner cartridge detachably attachable to an image forming apparatus, the toner cartridge comprising:

a replenishment toner including:

toner particles, and silica particles having a number average particle size of 110 nm to 130 nm, a large-diameter-side number particle size distribution index (upper GSDp) of less than 1.080, and an average circularity of 0.94 to 0.98, wherein 80 number % or more of the silica particles have a circularity of 0.92 or more, wherein the toner cartridge is configured to discharge the replenishment toner by rotation of the toner cartridge, wherein the toner cartridge includes:

a toner discharge port formed in an end face of the toner cartridge in a direction of a longer axis of the toner cartridge;

a toner accommodating portion; and a continuous protrusion formed in an inner surface of the toner accommodating portion so as to extend toward the toner discharge port in a helical pattern, and wherein the protrusion has an average width 150 to 2,500 times a volume average particle size of the toner particles and an average height 150 to 2,500 times the volume average particle size of the toner particles.

14. An image forming apparatus comprising:

a developing device comprising developer and a developer roller, wherein the developing device is configured to develop an electrostatic image with the developer to form a toner image; and a container including a replenishment toner to be supplied to the developing device, wherein the replenishment toner comprises:

toner particles; and silica particles having a number average particle size of 110 nm to 130 nm, a large-diameter-side number particle size distribution index (upper GSDp) of less than 1.080, and an average circularity of 0.94 to 0.98, wherein 80 number % or more of the silica particles have a circularity of 0.92 or more, wherein the replenishment toner container includes:

a toner discharge port formed in an end face of the replenishment toner container in a direction of a longer axis of the replenishment toner container;

a toner accommodating portion; and a continuous protrusion formed in an inner surface of the toner accommodating portion so as to extend toward the toner discharge port in a helical pattern, and wherein the protrusion has an average width 150 to 2,500 times a volume average particle size of the toner and an average height 150 to 2,500 times the volume average particle size of the toner.

* * * * *